US010583948B2

(12) United States Patent
Stollery et al.

(10) Patent No.: US 10,583,948 B2
(45) Date of Patent: Mar. 10, 2020

(54) STACKING OF FOLDED GLOVES

(71) Applicant: Safedon Limited, Framlingham, Woodbridge (GB)

(72) Inventors: Jonathan William Stollery, Melton (GB); Kim Marie Stollery, Melton (GB)

(73) Assignee: Safedon Limited, Framlingham, Woodbridge, Suffolk (GB)

( * ) Notice: Subject to any disclaimer, the term of this patent is extended or adjusted under 35 U.S.C. 154(b) by 0 days.

(21) Appl. No.: 16/065,196

(22) PCT Filed: Dec. 22, 2016

(86) PCT No.: PCT/IB2016/057947
§ 371 (c)(1),
(2) Date: Jun. 22, 2018

(87) PCT Pub. No.: WO2017/109753
PCT Pub. Date: Jun. 29, 2017

(65) Prior Publication Data

US 2019/0002148 A1 Jan. 3, 2019

(30) Foreign Application Priority Data

Dec. 23, 2015 (GB) ..... 1522852.1

(51) Int. Cl.
*B65B 63/04* (2006.01)
*B65B 35/50* (2006.01)
(Continued)

(52) U.S. Cl.
CPC ..... *B65B 63/045* (2013.01); *B65B 25/20* (2013.01); *B65B 35/50* (2013.01); *B65B 35/52* (2013.01);
(Continued)

(58) Field of Classification Search
CPC ..... B65B 63/045; B65B 35/52; B65B 25/20; B65B 35/50; A41D 19/0003; A41D 19/0055
(Continued)

(56) References Cited

U.S. PATENT DOCUMENTS 3,167,223 A * 1/1965 Weiss ..... D06F 89/02 223/37
5,697,762 A * 12/1997 Thompson ..... A41H 43/0214 112/470.36
(Continued)

FOREIGN PATENT DOCUMENTS

DE 1184728 1/1965
DE 1210763 2/1966
(Continued)

OTHER PUBLICATIONS

Search Report in GB1522852.1, UK Intellectual Property Office, dated Feb. 26, 2016.
(Continued)

*Primary Examiner* — Lynn E Schwenning

(57) ABSTRACT

A glove stacking apparatus forming a stack folded gloves has a supporting surface for supporting the stack as folded gloves are added to the stack along a stacking axis. First and second flaps are pivotable about first and second pivot axes opposite first and second sides of a glove stacking area. The supporting surface is relatively movable as folded gloves are added to the stack. A cyclic flap actuation system is configured to drive a folding action of each flap in which the flaps alternately pivot about the corresponding pivot axis so that each flap folds a first portion of a deposited glove overlapping a flap towards a second portion of the glove at the glove stacking area; the folding action alternating as gloves are added to the stack. Each flap in addition to being pivotable
(Continued)

is also laterally movable both towards and away from the stacking area.

26 Claims, 17 Drawing Sheets

(51) Int. Cl.
*B65B 25/20* (2006.01)
*B65B 35/52* (2006.01)
*A41D 19/00* (2006.01)

(52) U.S. Cl.
CPC ..... *A41D 19/0003* (2013.01); *A41D 19/0055* (2013.01)

(58) Field of Classification Search
USPC ..... 414/792.7, 754, 758
See application file for complete search history.

(56) References Cited

U.S. PATENT DOCUMENTS

| | | | | |
|---|---|---|---|---|
| 6,901,723 | B2 * | 6/2005 | Jordan | B65D 83/0805 221/38 |
| 9,090,427 | B2 * | 7/2015 | Stollery | A61L 2/18 |
| 9,315,353 | B2 * | 4/2016 | Stollery | A61L 2/18 |
| 10,131,508 | B2 * | 11/2018 | Stollery | B65B 35/50 |
| 2003/0031550 | A1 * | 2/2003 | Dube | B65G 57/035 414/789.5 |
| 2005/0106000 | A1 * | 5/2005 | Hogue | B65G 57/035 414/794.3 |
| 2010/0284776 | A1 * | 11/2010 | Johansson | B65G 57/18 414/791.6 |
| 2015/0232216 | A1 * | 8/2015 | Stollery | B65B 25/20 53/436 |

FOREIGN PATENT DOCUMENTS

| | | |
|---|---|---|
| DE | 1 212 031 | 3/1966 |
| DE | 1212031 | 3/1966 |
| FR | 2720761 | 12/1995 |
| GB | 1491844 | 3/1976 |
| GB | 2454753 | 5/2009 |
| GB | 2510428 | 8/2014 |
| WO | WO 2010 020782 | 2/2010 |
| WO | WO 2011 048414 | 4/2011 |
| WO | WO 2014 037701 | 3/2014 |

OTHER PUBLICATIONS

International Search Report and Written Opinion in PCT/IB2016/057947, dated Apr. 18, 2017.
Transmittal of International Preliminary of Patentability PCT/IB2016/057947, dated Dec. 7, 2017.

* cited by examiner

STACKING OF FOLDED GLOVES

BACKGROUND

Field of the Invention

The present invention relates to a glove stacking apparatus for preparing a stack of folded gloves prior to packing into a box, and to a method of stacking and folding gloves, particularly ambidextrous disposable hygienic gloves.

Related Art

The control of infection of patients in hospitals, clinics, and doctors' surgeries has become an ever more pressing concern with the rise of infectious bacteria resistant to multiple antibiotics, in particular methicillin-resistant *Staphylococcus aureus* (MRSA) and *Clostridium difficile* (*C. difficile*). In the United Kingdom alone there are thought to be about 5,000 deaths a year from infections caught in hospitals but some experts believe the number could be as high as 20,000.

Disposable medical gloves can help prevent cross-contamination, but a problem arises if external parts of the glove touch the same areas of a dispensing container as have previously been touched by hands which are contaminated with harmful micro-organisms. Such external parts of the gloves can then become contaminated prior to contact with a patient, if these external parts are the fingers or palm area of the glove the likelihood of a patient being contaminated is dramatically increased. To control contamination the cuffs of gloves should therefore be presented to the user from a glove dispenser, so that the user can don one glove at a time while avoiding skin contact with the external glove surfaces at the finger portions, and even the palm portions, of each glove.

In this specification, the term "finger portion" includes the portion of the gloves having glove thumbs, and the term "cuff portion" includes the portion of the glove having the cuff end. A transverse fold in a disposable medical inspection glove will be close to the point when the base of the thumb digit meets the base of the second (i.e. index) finger digit and so the base portion of the glove thumb may be on either side of this transverse folding line, depending on the exact length of the glove and the proportions of the moulded thumb and finger digits. The transverse fold will, in general, cut across a palm portion of the glove. As inspection gloves are most commonly ambidextrous, the "palm portion" may equivalently be termed a "dorsal portion" or "palm and dorsal portion" of the glove. The terms "finger portion" and "cuff portion" as used herein are therefore to be construed purposively, for example as the being, respectively the portion of the glove nearest the tips of the five digits and the portion of the glove nearest the cuff end and neither term excludes the palm and dorsal portion or the possibility that a base part of a digit may end up on the cuff side of a transverse fold line.

Therefore, because of the need to enhance infection Control, the preferred method of dispensing these gloves is by the cuff, so that the user can only remove the gloves from the container by the cuffs rather than by the glove fingers. One example of cuff first glove dispensing systems is disclosed in GB 2454753 A, which shows a cuff-first system in which cuffs are individually folded in half along a transverse axis approximately mid-way along the length of each glove, such that a finger portion of each glove is folded underneath a cuff portion of the same glove. Gloves are then dispensed from an edge of the stack which is held inside a box container having a dispensing aperture in one side face. An advantage of this glove dispensing system is that gloves are packed in an inexpensive box, made from card material and having a removable cover over an opening, with each glove folded over on itself so that the box may have an approximately cubic shape. A disadvantage of this arrangement is that all the cuffs are at one side of the stack, and as the cuff of inspection gloves typically have a rolled end and are therefore thicker, this side of the stack will end up being thicker, which limits how many gloves may fit inside a dispenser of any given size. Therefore it is preferable if the cuffs alternate on opposite sides of the stack. In this case, for there to be a single dispensing aperture, the aperture would have to extend across the top of the stack of gloves rather than across one side wall, and preferably the stack of gloves would be biased towards the dispensing aperture so that it was not necessary to reach into the dispensing aperture for a user to grasp the cuff of the next glove to be dispensed.

Another type of glove dispensing system is disclosed in GB 2510428 A, in which gloves are interfolded inside a stack of gloves for cuff-first dispensing from a dispensing aperture. The stack is packaged inside an inexpensive disposable plastic bag which is itself held inside a re-usable plastic box outer dispenser, which has a dispensing aperture, aligned with a dispensing aperture of the bag. In this specification, the term "interfolded relates to this type of glove folding arrangement, in which gloves are folded transversely proximate a mid-point along the length of the glove. The cuff portion of the next glove to be dispensed is accessible at one end of the stack and the finger portion of the same glove wraps behind the cuff portion of the subsequent glove to be dispensed, such that as each cuff-portion is pulled Out from the dispensing aperture, the finger portion of that glove being dispensed pulls the next cuff portion partially clear of the stack so that this preferably protrudes from the dispensing aperture, for easier manual access when that subsequent glove is to be dispensed. In this arrangement, within the stack (i.e. with the exception of the topmost and bottom-Most gloves of the stack) each glove is folded around portions of the two adjacent gloves, with each cuff-portion being sandwiched between the finger portions of the two adjacent gloves. Similarly, each finger portion is sandwiched between the cuff portions of the two adjacent gloves.

There are two ways in which gloves can be added to a stack and then interfolded with each other. In one way, the finger portion of each glove is deposited at the glove stacking area and a cuff portion is deposited over a folding flap; gloves can then be dispensed cuff-first from the top of the stack. In other way, this orientation is reversed; gloves can then be dispensed from the bottom of the stack.

Most gloves used in hospitals and clinics are examination gloves, and these are used in large numbers. Such gloves are supplied not in individual sterile packages, but in relatively inexpensive cardboard dispensing boxes. The size of boxed gloves is an issue owing to the need to minimise the space needed to store gloves, or the size of dispensing apparatus holding boxed gloves. It is therefore desirable to pack as many gloves as possible into the stack of gloves held within a glove dispenser. As there is a limit to reducing material thickness, the need is therefore to stack gloves as evenly as possible with a minimum of trapped air within the stack of gloves.

Examples of equipment suitable for forming a stack of folded gloves, whether interfolded or not, is disclosed in patent documents WO 2010/020782 A2, WO 2011/048414

A1 and WO 2014/037701 A1. Gloves are transversely folded and held within a packing recess that has a floor with a supporting surface that is relatively movable away from an entrance to the recess such that as a stack of gloves inside the recess grows the top of the stack remains substantially at the same level as the top of the recess. The top of the stack therefore presents a glove stacking area on which subsequent folded gloves may be added to the stack.

To automate the process, glove folding flaps are provided, disposed at opposite sides of the glove stacking area. A packing plate may be provided between the recess floor and the bottom of the growing stack, and a sheet-like packing insert may be provided atop the packing plate and folded upwards a short distance where the packing plate meets recess wall surfaces to prevent portions of gloves from falling into a clearance gap between the packing plate or recess floor and the adjacent wall surfaces of the recess. The packing plate is useful in removing the completed stack from the recess. The completed stack is compressed in the direction of the height of the stack, i.e. along a stacking axis drive, by placing the open mouth of an inverted, rigid packing box over the glove stacking area at the top of the recess, and then driving the recess floor upwards to compress the stack between the packing plate and the opposing, downwardly facing, inside base surface of the inverted box, until the packing plate comes into contact with the open mouth of the box when all the gloves are compressed into the packing box. The packing plate and packing box are provided with interengaging magnets when these meet so that the compressed stack can be easily removed from the packing recess for final packing of the stack of gloves into a dispensing container. The dispensing container may be a card dispenser or a bag dispenser, and in each case it is advantageous if the dispenser lines the inside of packing box. The packing plate can then be removed from the packing box opening, and the dispenser closed where this was left open to allow insertion of the glove stack into the lined packing box.

It is an object of the present invention to provide an apparatus and method for stacking gloves prior to packing in a dispensing box. It is also an object of the present invention to reduce the packing volume of a given number of stacked gloves or to increase the number of gloves contained within a stack having a given packing volume.

SUMMARY OF THE INVENTION

According to the invention, there is provided a glove stacking apparatus for forming a stack of folded gloves, comprising:

a supporting surface for supporting said stack as folded gloves are added to the stack along a stacking axis;

a first flap pivotable about a first pivot axis and a second flap pivotable about a second pivot axis, said first and second axes being disposed on corresponding opposite first and second sides of a glove stacking area within which gloves folded by said flaps are, in use, added to the stack, the supporting surface being relatively movable along a stacking axis away from said glove stacking area as said folded gloves are added to the stack;

a cyclic flap actuation system configured to drive a folding action of each flap in which said flaps alternately pivot about the corresponding pivot axis from a first orientation in which said flap is positioned on its corresponding side of the glove stacking area to a second orientation in which said flap extends over the glove stacking area, whereby each flap when in the first orientation is configured to fold a first portion of a deposited glove overlapping said flap towards a second portion of said glove deposited at the glove stacking area as said flap pivots to the second orientation, the folding action of said flaps alternating as gloves are added to the stack;

and wherein each flap in addition to being pivotable about the corresponding axis is also laterally movable both towards and away from the glove stacking area and comprises a plurality of fingers for folding said first portions, said fingers extending in a lengthwise direction and being separated by gaps;

following the folding action said flap actuation system is configured to drive a withdrawing action of each flap in which said flaps are alternately withdrawn from the glove stacking area, said flap to be withdrawn being maintained in the second orientation while being laterally moved away from the glove stacking area along said lengthwise direction until said fingers are withdrawn from the glove stacking area;

following the withdrawing action said flap actuation system is configured to drive a returning action of each flap in which said withdrawn flap is pivoted about the pivot axis and laterally returned to the first orientation ready for the next folding action, whereby the flap actuation system completes a cycle; and said apparatus further comprises a first supporting platform and a second supporting platform, said first and second platforms being disposed, respectively on said opposite first and second sides of the glove stacking area for supporting said first portion of a deposited glove prior to folding of said first portion by the fingers of the corresponding flap, each supporting platform having a plurality of slots therein, the slots of each platform being aligned with the fingers of the corresponding flap to accommodate movement of said fingers during said cycle of the flap actuation system.

Also according to the invention, there is provided a method of forming a stack of folded gloves using a glove stacking apparatus for forming a stack of folded gloves, the apparatus comprising: a supporting surface for supporting said stack as folded gloves are added to the stack along a stacking axis; a first flap pivotable about a first pivot axis and a second flap pivotable about a second pivot axis, said axes also being laterally movable with respect to a glove stacking area within which gloves folded by said flaps are, in use, added to said stack, said first and second axes being disposed on corresponding opposite first and second sides of a glove stacking area and the flap comprising a plurality of fingers that extend away from the corresponding pivot axis; a cyclic flap actuation system configured to drive a folding action of each flap in which said flaps alternately pivot about the corresponding pivot axis; and a first supporting platform and a second supporting platform, said first and second platforms being disposed, respectively on said opposite first and second sides of the glove stacking area, the first supporting platform be configured to be used in conjunction with the first flap and the second supporting platform being configured to be used in conjunction with the second flap, each supporting platform having a plurality of slots therein, wherein the method comprises:

depositing a sequence of gloves to be folded into a stack by said apparatus, each glove having a first portion and a second portion, one of said portions being a finger portion and the other of said portions being a cuff portion, the first portion of each glove being deposited, alternately, at one or the other of said platforms and the second portion of each glove being deposited at the glove stacking area;

when a glove is deposited with the first portion at the first platform, using the first platform to support said glove and using the flap actuation system to pivot the fingers of the first flap about the first pivot axis in a folding action of said flap to lift said first portion off the first platform and to fold said first portion towards the glove stacking area until the fingers of the first flap extend over the glove stacking area, said folded glove thereby being added at the top of the stack of folded gloves;

when a glove is deposited with the first portion at the second platform, using the second platform to support said glove and using the flap actuation system to pivot the fingers of the second flap about the second pivot axis in a folding action of said flap to lift said first portion off the second platform and fold said first portion towards the glove stacking area until the fingers of the second flap extend over the glove stacking area, said folded glove thereby being added at the top of the stack of folded gloves;

as said alternately folded gloves are added to the stack of folded gloves, using the supporting surface to support said stack whilst relatively moving the supporting surface away from the glove stacking area so that the top of said stack remains substantially level with said pivot axes so that said flaps may continue to alternately fold and add to said stack subsequently deposited gloves;

after each folding action using the flap actuation system to drive a withdrawing action of the corresponding flap in which said fingers are laterally withdrawn towards a side of the glove stacking area, said fingers thereby being withdrawn from said stack;

after each withdrawing action, using said flap actuation system to pivot and laterally move said flap in a returning action of the corresponding flap to return said flap to a position ready for a subsequent folding action; and either during the folding action or during the returning action of each flap, passing the fingers of said flap through the slots in the corresponding supporting platform.

The slots may be apertures that allow passage of the fingers through the platform during the cycle of the flap actuation system. Alternatively, the slots may be grooves in a top surface of each platform, in which case the flaps in the returning action move the fingers into the grooves prior to the next folding action of said fingers.

The method may comprise an initial step of first moving the supporting surface proximate the level of the glove stacking area prior to deposition of the first glove.

If the recess has a movable floor that provides the supporting surface, then this floor may then be relatively lowered as required to keep the top of the stack of gloves in the recess substantially level with a desired level of the glove stacking area and the adjacent flaps and supporting platforms.

In a preferred embodiment of the invention, the apparatus comprises a glove packing recess, the recess having an opening through which folded gloves must pass as the stack grows, the opening therefore defining the glove stacking area. Preferably, the recess helps to contain and define the exterior shape of the stack of gloves as the stack is being formed.

The recess may simply be a frame that extends around the glove stacking area. Preferably, the recess has side rails or side walls that extend downwardly from the glove stacking area and that align the stack and help to define a substantially rectangular cross-section about the stacking axis of the growing stack, which may therefore be the same as an axis of the recess. At least some of the walls may be continuous and optionally be tapered outwards from the stacking axis in a downwards direction away from the glove stacking area, in order to minimise friction and binding with the external portions of stacked folded gloves, as the supporting surface moves away from the glove stacking area during the addition of folded gloves to the stack, or during a subsequent glove packing stage when excess air is compressed out of the completed stack by driving the supporting surface relatively upwards with respect to the glove stacking area prior to removal of the stack from the recess and packing into a bag, box or other container from which gloves will, in use, be dispensed.

The supporting surface may be provided, ultimately, by a floor that is relatively movable away from the glove stacking area. In this packing process, it is preferred if the lowermost glove in the stack of gloves rests directing in a thin packing insert or sheet that extends across the base of the recess and upwards around its periphery. A packing plate may also be provided above the floor and beneath the packing insert. The packing plate may be used to compress and contain the stack inside a rigid packing box after completion of the stack, prior to enclosing the stack inside a card material container or bag-like container having a dispensing aperture for cuff-first dispensing of the gloves. Examples of such packing recesses, packing plates, packing boxes and containers are known to those skilled in the art, for example as disclosed in patent documents WO 2010/020782 A2, WO 2011/048414 A1 and WO 2014/037701 A1 and as mentioned in the above introduction to this specification, and so will not be further described in detail.

The recess preferably has side walls or rails for aligning gloves stacked one on another inside the recess and a movable supporting surface which can be lowered as said stack of gloves grows so the topmost glove in the stack of gloves is substantially level with a top edge of the recess, which may be inset in a work surface. Although it is in principle possible that the supporting surface may be fixed and other components including the flaps may be upwardly movable. This is not preferred, however, as the stack, when completed, may be 600 mm, and so this may entail more mechanical complexity than having a downwardly movable supporting surface.

An actuator may be provided for moving the supporting surface downwardly so that the stack of gloves continues to be retained within the recess as gloves are added to the stack.

Preferably, the compression of the stack of gloves by the fingers of each flap provides a motive force for moving the supporting surface downwardly.

The movable flaps are preferably adjacent opposite edges of a recess which helps to define the edges of the stack as a portion of each deposited glove that initially overlaps one or the other of these edges folded towards the recess.

The, or each, flap may be hinged adjacent the corresponding side of the glove stacking area, the hinge then providing the corresponding pivot axis.

In a preferred embodiment of the invention, the recess is substantially square or rectangular and there is a pair of flaps on opposite side edges of the recess for folding alternately inwards to the recess portions of gloves overlapping alternately one or another of said opposite side edges of the recess. In this case, the glove stacking area is defined as the area within the topmost edges of the recess.

Preferably, the, or each, flap is arranged to fold towards the recess such that, in use, the fingers of each flap contact and continue to press against the stack of folded gloves formed in the recess in order to help compress the stack of gloves.

The flap actuation system will, in general, have a first and a second glove folding actuator for individually driving, respectively, the folding action of the first flap and the second flap. The flap actuation system will also, in general, have a first and a second flap movement actuator for individually driving, respectively, the lateral movement of the first flap and the second flap with respect to the glove stacking axis.

The operation of the first glove folding actuator and the first flap movement actuator are preferably synchronised during the returning action so that the flap can be both pivoted about the first axis while at the same time the first axis is moved laterally towards the glove stacking area as the first flap returns to aft orientation ready for the next folding action. The second glove folding actuator and the second flap Movement actuator are also preferably synchronised in the same way with relation to the second flap and second pivot axis.

The supporting surface is relatively movable along the stacking axis, which will normally be a vertical axis, with respect to the glove stacking area, which will, in use, be at the top of the stack of gloves that is being formed, so that the flaps may be used to alternately fold in towards the glove stacking area the portion of each deposited glove that overlaps one or the other of the flaps. This relative movement may most conveniently be provided if the support surface is movable away from the level of the glove stacking area. This relative movement may, however, alternatively be achieved by repositioning the flaps further away from a stationary supporting surface, or by a combination of movement of the supporting surface and the flaps.

The relative movement may be passive or automatic, for example driven by the increasing weight of the stack of gloves or by downward pressure exerted by the flaps as the flaps fold glove portions towards the glove stacking area and onto the top of the stack of glove being formed. Alternatively, an actuator may be provided to actively effect the relative movement of the supporting surface.

In either case, the apparatus may comprise an elevation adjustment mechanism configured to relatively move the supporting surface with respect to the first and second flaps along the stacking axis in order to keep the glove stacking area positioned substantially between the pivot axes as gloves are added to the stack.

The first and second flaps and the supporting surface are part of a glove folding and stacking station at which glove are to be deposited. Gloves may be moved towards the glove stacking area by means of a conveyor, the location and orientation of each glove being determined by a machine vision system, following which gloves are individually lifted from the conveyor and deposited partially over one or the other of the flaps and partially over the growing stack within the glove stacking area. The details of the conveyor and glove depositing apparatus are not central to the invention, which essentially concerns the glove folding and stacking apparatus and process after the deposition of gloves.

Each platform will, in general, have an upper surface and a lower surface. The upper surface is configured to provide support to the first portion of a deposited glove.

The withdrawing action of each flap may take place beneath the lower surface. Each withdrawn flap may therefore extend beneath the corresponding supporting platform lower surface.

The fingers of each flap pass through the slots of the corresponding platform preferably during the folding action of the flap.

In a preferred embodiment of the invention, each flap, during the returning action simultaneously pivots about the corresponding pivot axis and moves laterally such that the pivot axis moves towards the glove stacking area.

The withdrawing action of each flap preferably does not occur until after the folding action of the other flap. As a result of this, the fingers of both flaps are in contact with the stack for an interval until the withdrawing action has occurred.

Adjacent fingers of each flap are separated by a corresponding gap. So that the flaps do not interfere with each other when both are in contact with the folded stack of gloves, it is preferred if at least one finger of each flap is aligned with a corresponding gap between fingers of the other flap when the fingers of both flaps are in contact with the stack.

The width of each one of the gaps in each flap is preferably greater than the width of the finger in the other flap with which said gap is aligned.

Preferably, the width of the, or each, gap is between 2 and 10 times the width of the finger with which said gap is aligned. In a preferred embodiment of the invention, the fingers are aligned centrally with the corresponding gaps in the other flap.

The flap may be a fork-like flap, the fingers having the forms of tines that extend from a common base portion of each flap. In one embodiment, the base portion comprises a pivot shaft. In another embodiment, the base portion is a member that extends radially away from a pivot shaft. In either case, rotation of the pivot shaft defines the pivot axis.

The flap actuation system may be configured to maintain each flap in the second orientation after each folding action to apply a downward pressure to the stack until after the other flap has completed the subsequent folding action.

In a preferred embodiment of the invention, the flap actuation system is configured to apply a continuous pressure along the stacking axis to the stack through one or both of the flaps as gloves are added to the stack. Most preferably, at least one flap applies a compressive force to the stack at all times during the alternate folding of gloves as gloves are added to the stack.

The most common types of inspection glove are dip moulded on hand-shaped formers in latex or nitrile material. Gloves are then stripped from the formers, which inevitably results in air entering the glove interior. Gloves may be stripped either manually or in an automated process, and in either case each stripped glove has a unique configuration when laid flat, for example on a conveyor. These factors mean that there will, inevitably, be unwanted air pockets both inside gloves and between adjacent glove external surfaces once gloves have been folded into the stack. In principle, air can be squeezed out in a later processing step, however, it has been found in practice that this can take many minutes. The present invention greatly reduces the time needed to expel air from the stack, because the flaps remain in contact with the newly folded glove for a longer period of time as compared with the prior art in which a flap simply pivots away from the folded glove, retracing its path prior to the next folding action. The material of the most gloves is elastomeric and so will naturally tend to spring back, drawing in more air as soon as the flap is folded back. By moving the flap laterally away in the withdrawing step, this effect is reduced. Furthermore, there is no unwanted lifting effect due to air suction as the flap is removed. All these factors help stabilise the stack, particularly when at least one flap is always in contact with the stack and most particularly when One or both flaps are applying a compressive force prior to withdrawal.

In a preferred embodiment of the invention, each flap comprises a base portion proximate the pivot axis of the flap, with the fingers of the flap extending away from the base portion.

The pivot axis may be provided by at least one pivot shaft the, or each, shaft being rotatable about the corresponding pivot axis.

The base portion of each flap may comprise a shaft. The shaft may then extend laterally away from the flap towards a rotation and translation actuator for rotating the shaft about the corresponding pivot axis and for moving the shaft laterally both towards and away from the glove stacking area as required during the withdrawing and returning actions.

The flap actuation system may be configured during the withdrawing action to laterally move the flap such that the pivot axis of each flap moves away from the stack until the flap is fully withdrawn from the stack and then during the returning action to pivot the flap about the corresponding pivot axis while at the same time laterally moving the flap such that the pivot axis of each flap moves back towards the stack.

During the folding action each flap may rotate above a stacking plane passing through the stacking area.

During the returning action each flap may rotate below the stacking plane.

Each of the pivot axes may be provided by at least one pivot shaft rotatable about the corresponding pivot axis, each pivot shaft rotating and moving laterally beneath the corresponding supporting platform as the flap actuation system drives each flap throughout the cycle of the flap actuation system.

Preferably, each of the pivot axes is provided by at least One pivot shaft rotatable about the corresponding pivot axis, the pivot shaft carrying the corresponding fingers beneath the corresponding supporting platform as the flap actuation system drives each flap throughout the withdrawing action and returning action.

In a preferred embodiment of the invention, the slots in the platform separate adjacent platform strips. The platform may have a base portion, the strips extending in a lateral direction relative to the stacking axis towards the glove stacking area. Preferably, the strips are wider than the slots so that the supported glove does not sag significantly into the slots.

As the glove stack grows an elevation adjustment mechanism may be used to relatively move the supporting surface with respect to the flaps along the stacking axis in order to keep the glove stacking area positioned substantially between the pivot axes as gloves are added to the stack.

The glove stacking apparatus may be used as part of an apparatus for transporting and stacking folded gloves in a stack, comprising at least one conveyor for transporting the gloves to be stacked, a glove position sensor for sensing the presence and orientation of the transported gloves on the conveyor, a processor, the apparatus further comprising a glove depositing apparatus for moving the transported gloves from the glove conveyor and depositing the gloves one at a time over the glove stacking area and alternately one or the other of the supporting platforms, to form the folded stack supported by the supporting surface.

The glove depositing apparatus may include a lifting and depositing actuator for lifting each of the gloves to be moved from the conveyor and for depositing each of the lifted gloves over the glove stacking area and one or the other of the supporting platforms.

The processor is connected to the glove position sensor and to the glove depositing apparatus for controlling the deposition of gloves in accordance with the sensed presence and orientation on the conveyor so that, in use, the glove depositing apparatus lifts gloves from the conveyor and deposits the gloves on the glove stacking area and one or the other of the adjacent supporting platforms as described above.

The sensor may sense additionally the orientation of a cuff portion and/or thumb portion of each of the transported gloves on the conveyor, and the processor may be arranged to control the operation of the glove depositing apparatus in accordance with the sensed orientation so that, in use, a lifting and depositing portion of the glove depositing apparatus lifts gloves from the conveyor and deposits the gloves correctly oriented for alternate folding to form the stack with the cuff portion and finger portion of each deposited glove in a desired orientation with respect to other gloves in the glove stacking area and adjacent supporting platforms.

The lifting and depositing portion of the glove depositing apparatus may be connected to a pneumatic system for controlling a vacuum lift of the gloves, the vacuum lift being released prior to, or simultaneously with, depositing of the gloves. The lifting and depositing portion May include a lifting surface against which, in use, the gloves are held when moved and positioned by the glove depositing apparatus prior to depositing for stacking.

When the glove depositing apparatus includes a lifting and depositing portion, this may be used to lift each of the gloves to be moved from the conveyor and to deposit each of the lifted gloves at the stacking station.

The pneumatic system for applying a vacuum to a lifted glove in order to adhere the lifted glove to the glove depositing apparatus may act through a downwardly directed surface of a glove lifting and depositing head at the end of a robotic actuator arm.

BRIEF DESCRIPTION OF THE DRAWINGS

The invention will now be further described, by way of example only, and with reference to the accompanying drawings, in which.

DETAILED DESCRIPTION OF THE INVENTION

Figure 1:
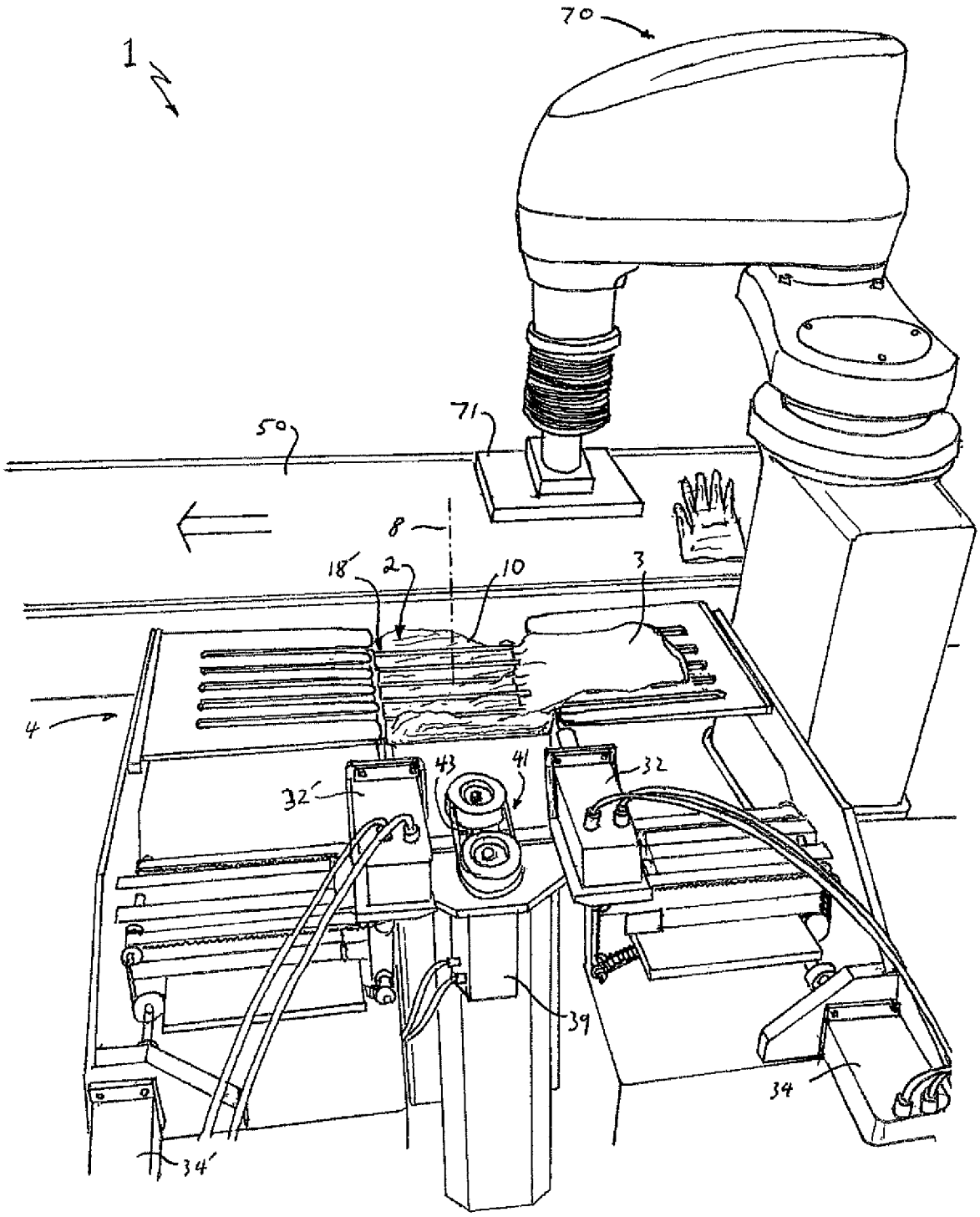
FIG. 1 is a perspective view of a glove stacking apparatus for forming a stack of folded gloves in a first preferred embodiment of the invention, comprising a glove stacking station having a pair of flaps on opposite sides of an opening to a glove packing recess in which gloves are alternately folded inwards to form an interfolded stack of gloves.
Figure 2:
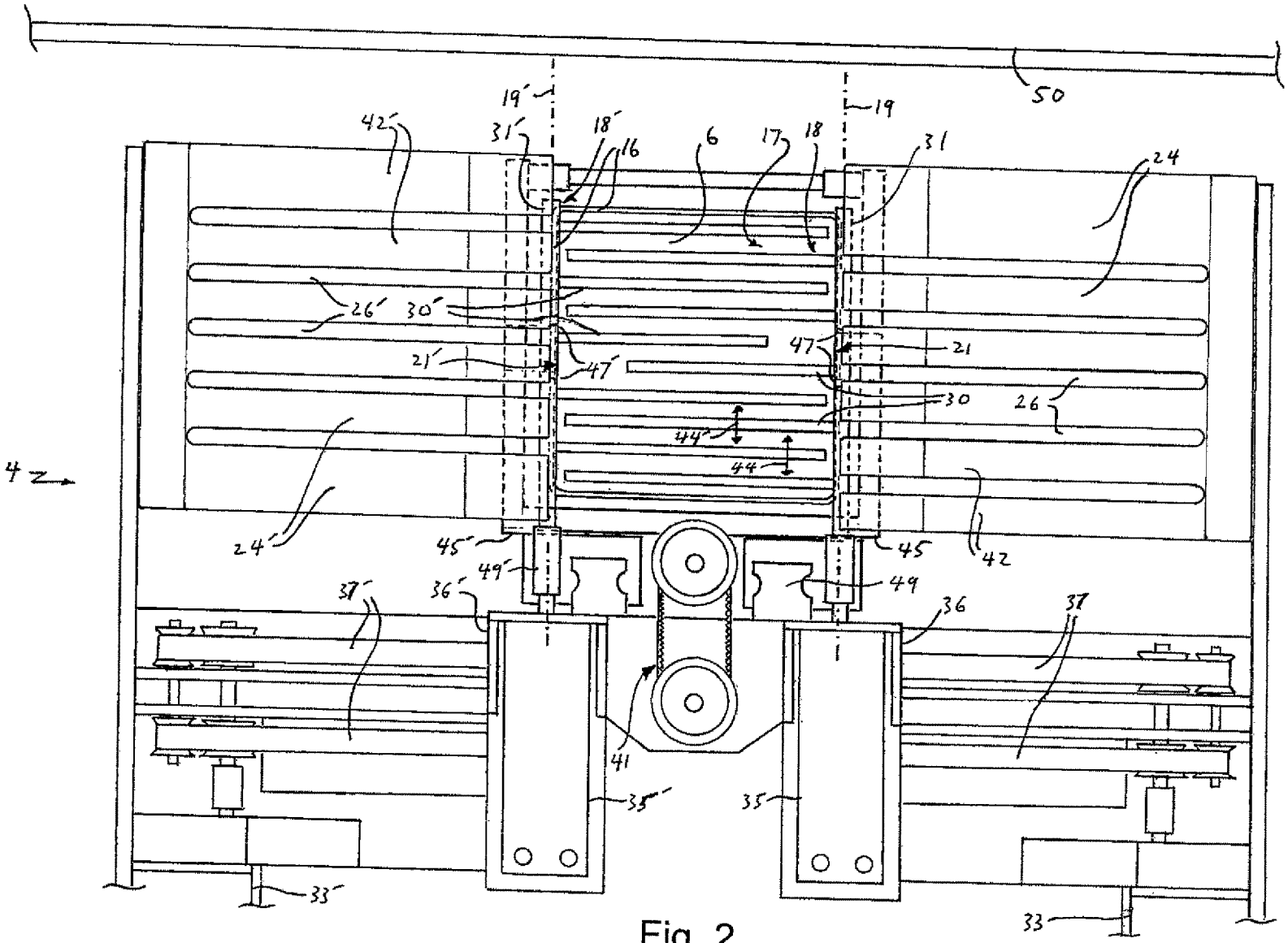
FIG. 2 is a view from above of the glove stacking station of FIG. 1, with no gloves held by the recess showing how the flaps each have a plurality of fingers that extend substantially perpendicularly from a pivot shaft, and which are interlaced when both are folded over the glove packing recess, and showing how an adjacent pair of supporting platforms each has a series of slots aligned and sized to allow passage of the fingers through the platforms.

FIG. 1 is a perspective view of a first embodiment of a glove stacking apparatus 1 in the process of forming a stack 2 of ambidextrous folded gloves 10. A central portion of the apparatus in which the gloves are folded and stacked is referred to herein as a glove stacking and folding station 4. FIG. 2 shows a top view of the station 4 prior to any gloves being provided to the station, and FIG. 3 shows a schematic representation of the apparatus 1.

The apparatus 1 comprises a supporting base or surface 6 for supporting the stack 2 as folded gloves 10 are added to the stack along a stacking axis 8, which in this example is a vertically orientated axis. As shown in the schematic cross-sections starting with FIG. 4C, in this example the supporting surface is supported ultimately by a movable floor 12. The supporting surface 6 as illustrated is provided by a packing plate 14 which rests on the movable floor. Optionally, there may also be a thin paper or plastic packing sleeve 15 atop the packing plate, as shown in dashed outline in FIG. 4C, to prevent folded gloves from becoming trapped between the packing plate or floor and adjacent side wall surfaces 16 of a packing recess 17. In this case, an upper surface 6' of the packing sleeve would provide the supporting surface. The operation and form of such a packing recess, packing sleeve, packing plate and movable floor, together with a rigid packing box into which the completed stack is ejected and compressed, is described more fully in patent documents WO 2010/020782 A2, WO 2011/048414 A1 and WO 2014/037701 A1, the contents of which in this regard are therefore incorporated in this specification by reference. From these documents, the skilled person will appreciate that the recess may take other forms than that illustrated.

The apparatus 1 comprises a first flap 18 pivotable about a first pivot axis 19 and a second flap 18' pivotable about a second pivot axis 19', these axes being parallel with each other and perpendicular with and laterally offset from the stacking axis 8. The first and second axes 19, 19' are disposed on corresponding opposite first and second sides 21, 21' of a glove stacking area 20 within which gloves 10 folded by the flaps are, in use, added to the stack 2. The glove stacking area is shown schematically with cross-hatching in FIG. 3, and has a shape defined by the opening to the packing recess 17. The supporting surface 6 is relatively movable along the stacking axis 8. In this example, this is done by moving the floor 12 away from the glove stacking area 20 as folded gloves 10 are added to the stack 2.

Figure 3:
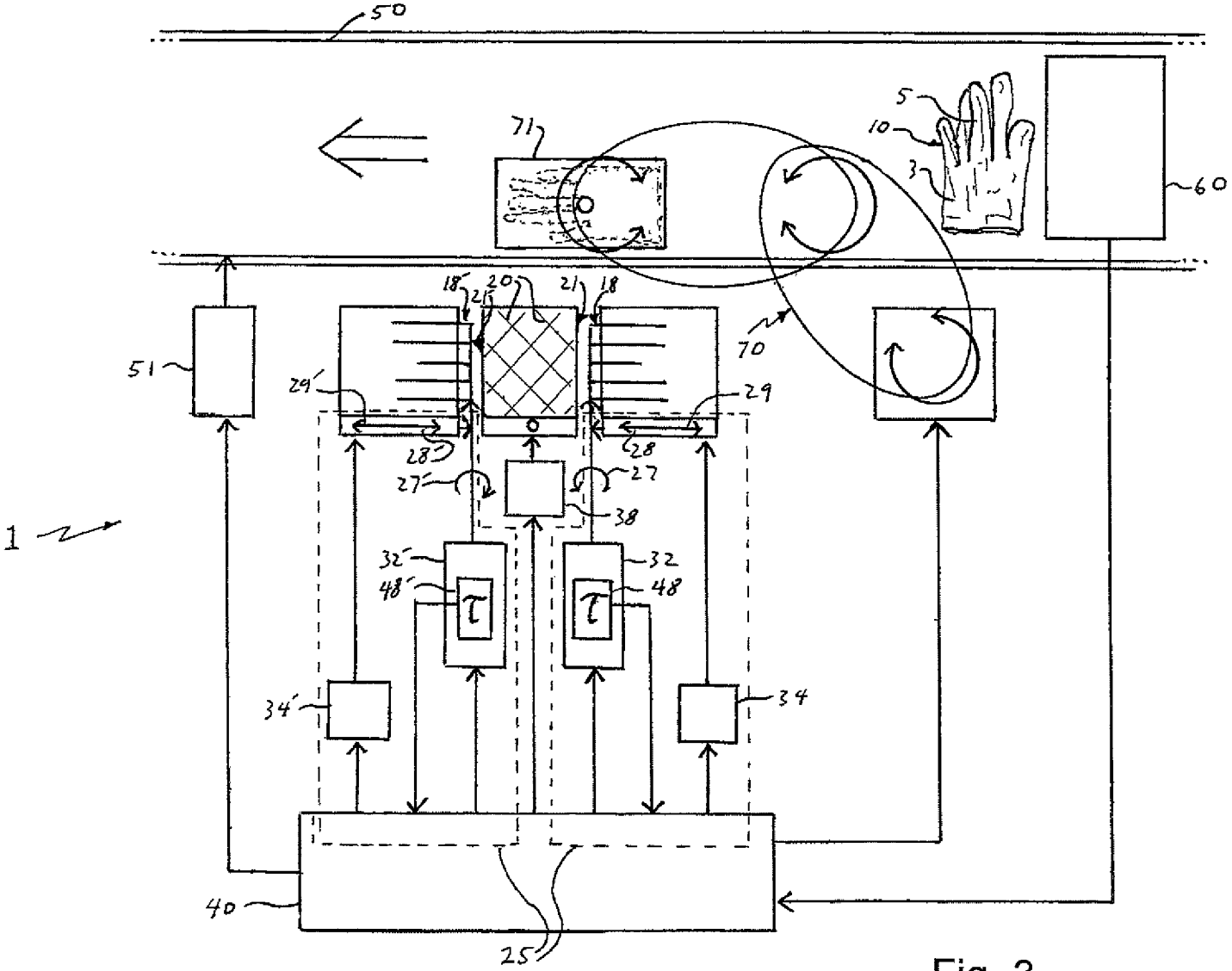
FIG. 3 is a schematic diagram of the glove stacking apparatus of FIG. 1, showing how a controller controls the operation of a number of actuators including a rotational actuator and a linear actuator for each of the flaps and a linear actuator for moving a floor of the packing recess away from a glove stacking folding area proximate the top of the packing recess.

The apparatus comprises a cyclic flap actuation system 25, shown schematically in dashed outline in FIG. 3, that is configured to automatically drive a folding action of each flap 18, 18' in which the flaps alternately pivot 27, 27' about the corresponding pivot axis 19, 19' between a first orientation in which each flap extends from the corresponding pivot axis 19, 19' in a direction away from the glove stacking axis 8 to a second orientation in which each flap extends from the corresponding pivot axis 19, 19' in a direction towards the glove stacking axis 8. The flaps are preferably long enough such that the flaps in the second Orientation extend beyond the glove stacking axis.

In this example, each flap 18, 18' always pivots in the same direction, the handedness of the pivoting movement always being opposite for the two flaps.

Each flap 18, 18', when in the first orientation, is configured to fold a first portion 3 of a deposited glove 10 overlapping the flap towards a second portion 5 of the glove that has been deposited at the glove stacking area 20 as the flap pivots to the second orientation. This automatic folding action of the flaps alternates as gloves are added to the stack, such that glove folds are formed alternately, at the first and second sides 21, 21' of the glove stacking area 20.

In this example, the glove first and second portions 3, 5 are, respectively, cuff and finger portions of each glove 10, and will therefore for the sake of clarity only be referred to as such in the following description. The stacking process described below forms an interfolded stack of gloves which, when packed into a box dispensing container or bag-like dispensing container having a dispensing aperture, will dispense gloves cuff-first from a dispensing end of the stack, which would, in this example, be the top end of the stack as oriented in FIG. 1. Usually, the glove stack is oriented during dispensing such that glove cuffs hang downwards from a downwardly facing dispensing aperture. The folding arrangement can, however, be reversed during manufacture, with the first portion being the finger portion and the second portion being the cuff portion, in which case the dispensing end of the stack 2 as being formed in FIG. 1 would be at the bottom of the stack, up against the supporting surface 6. The person skilled in the art will appreciate that the invention is equally applicable to both of these cases, however it is normally more convenient to form the stack as illustrated, as then the completed stack can be transferred by pressing the stack upwards into a dispensing container having a preformed dispensing aperture, this dispensing container lining five sides of an open, rigid packing box. Prior to this, the last folded glove at the top of the stack can be manually adjusted by a worker to fold the cuff-end on to the stacking axis so that this is conveniently presented at the dispensing aperture when this is first opened. The finger portion of each glove, when dispensed by the cuff, then pulls the cuff portion of the next glove partially out of the dispensing aperture to facilitate dispensing of the next glove, thereby minimising the possibility of finger born contamination on finger portions of each dispensed glove.

Each flap 18, 18', in addition to being pivotable about the corresponding pivot axis 19, 19', is also laterally movable by the flap actuation system 25 both towards 28, 28' and away 29, 29' from the stacking axis 8. The first and second flaps each also comprise a plurality of fingers 30, 30' that extend away from corresponding first and second pivot shafts 31, 31' that define the first and second pivot axes 19, 19' of the flaps. The flap fingers are configured to lift and then fold over the glove cuff portions during each folding action.

The flap fingers preferably have a rounded cross-section. In this example the flap fingers have a circular cross-section which helps to minimise frictional drag between the flap fingers and adjacent glove layers during a withdrawing action, described below.

The apparatus further comprises first and second supporting platforms 24, 24' that are disposed, respectively, on the opposite first and second sides 21, 21' of the glove stacking area 20. These platforms provide support to the cuff portion 3 of a deposited glove 10 prior to folding of the cuff portion 3 towards and onto the growing stack 2 at the stacking area by the fingers 30, 30' of the corresponding flap 18, 18'. As can be seen most clearly in FIG. 2, each supporting platform 24, 24' has a plurality of slots 26, 26' that are aligned with the fingers 30, 30' of the corresponding flap. In this example, each slot is an aperture through the corresponding platform. Between the slots 26, 26' each platform has slats or projections 42, 42'. The flap fingers 30, 30' are separated by gaps 44, 44'. The platform slats are aligned with corresponding finger gaps. As explained in more detail below, sufficient clearance, in practice about 1 mm on each side, is provided so that the slots in each platform allow passage of the fingers through the corresponding platform as the flap cyclically automatically moves through a repeating series of actions under the overall control of a control system 40, which may be a microprocessor-based system.

Part of the cyclic flap actuation system 25 may be combined within the overall control system 40. The flap actuation system 25 also comprises first and second hydraulically power rotation actuators 32, 32' for pivoting 27, 27' each of the flaps about the corresponding pivot axis 19, 19', and first and second hydraulically powered linear actuators 34, 34' for laterally moving 29, 29' the corresponding pivot axes. Each rotation actuator comprises a hydraulic motor 33, 33' and each linear actuator has a hydraulic motor 35, 35'. The rotation motors drive the pivot axes directly. Each rotation motor is mounted on a laterally movable carriage 36, 36' that is laterally driven from a belt-driven drive chain 37, 37' powered by the corresponding linear motor 35, 35'.

The control system 40 also controls the operation of another linear actuator 38 that controls the elevation of the recess floor 12. This vertical linear actuator 38 comprises a hydraulic motor 39 connected via a belt drive chain 41 to a vertical shaft worm gear 43 (see also FIGS. 6A, 6B and 6C). The worm gear when turned one way or the other drives the floor 12 up or down. The worm gear 43 is connected to the floor via a pair of side brackets 45, 45' through a pair of opposite side slots 47, 47' in opposite recess walls 46, 46'. Vertical movement of the bracket and worm gear is guided by a pair of vertically extending rails 49, 49' on either side of the worm gear 43.

Figure 4C:
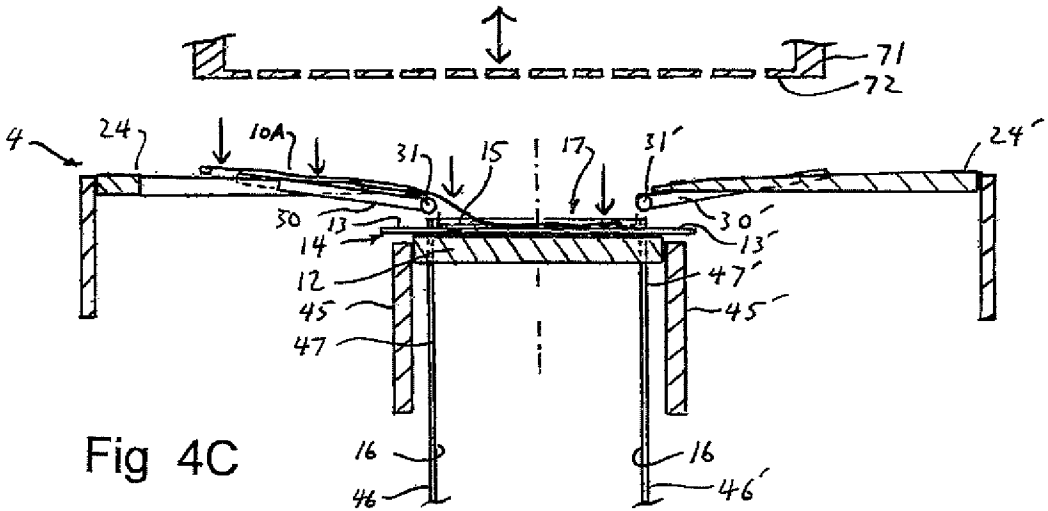
FIGS. 4C and 4D are schematic cross-section views of the apparatus of FIG. 4A, showing how a first glove is deposited partially over a first flap and the associated supporting platform and partially over the glove stacking area, followed by deposition of a second glove over a second flap and the associated supporting platform and partially over the first glove at the stacking area, the fingers of each flap being directed away from the glove stacking area.
Figure 4D:
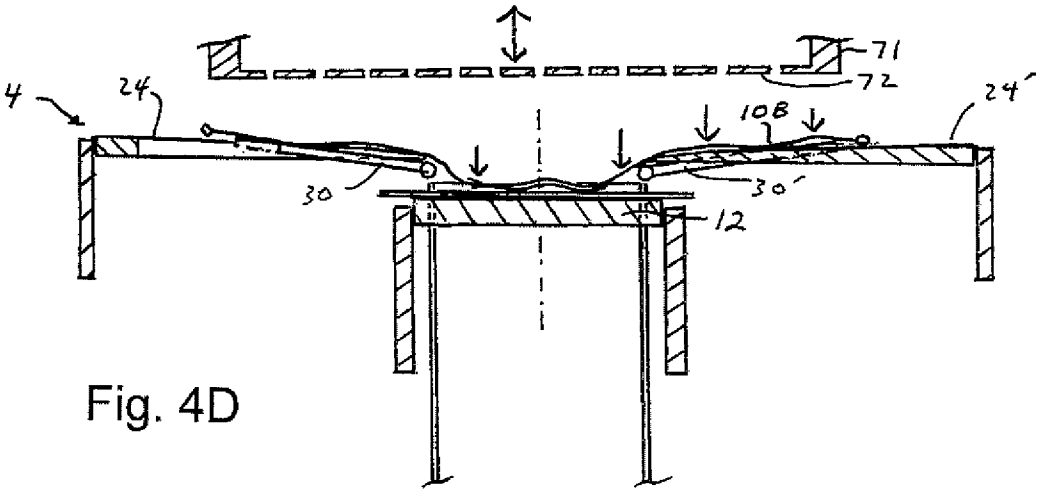
Figure 4A:
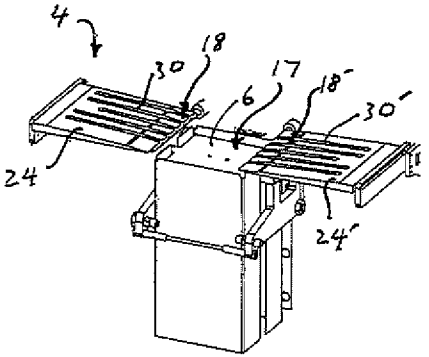
FIGS. 4A and 4B are perspective and front side views of the packing recess, supporting platforms and flaps in an initial orientation prior to folding and stacking of gloves.
Figure 4B:
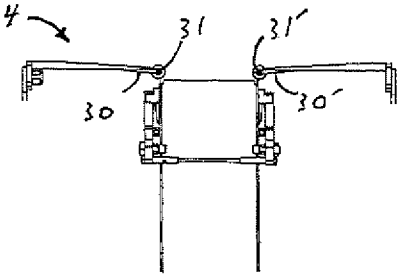

The operation of the apparatus 1 will now be more fully described, starting with FIGS. 4A and 4B. Initially, before deposition of any gloves, the supporting surface 6 is proximate, and ideally just below, the level of a horizontal plane extending between the pivot axes 19, 19'. The flap fingers 30, 30' all extend horizontally away from the pivot axes which are initially in line above corresponding opposite side walls 46, 46' of the recess 17, adjacent opposite sides 21, 21' of the glove stacking area 20.

Gloves are transported to the glove stacking station 4 by a conveyor belt 50. The speed of the belt is set by a conveyor belt drive motor 51, which is controlled by the control system 40. A machine vision system 60 provides to the control system 40 an indication of the position and orientation of each glove 10. A robotic arm actuator 70, has a glove lifting and depositing head 71 with a vacuum lifting plate 72, which is controlled by the control system 40 to lift passing gloves 10 off the belt 50 and to deposit these, one at the time, at the glove stacking and folding station 4 with cuff portions 3 overlapping, alternately the first and second support platforms 24, 24', as described above.

Figure 6A:
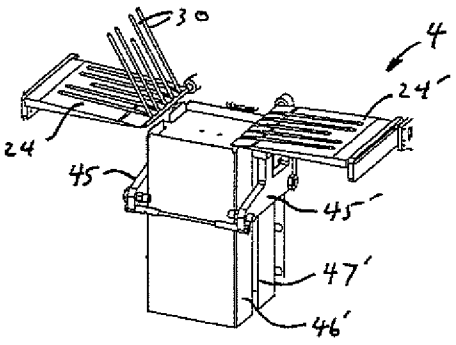
FIGS. 6A, 6B and 6C are perspective, front side and lateral side views following from FIGS. 5A and 5B, showing further pivoting of the flap fingers towards vertical.
Figure 5A:
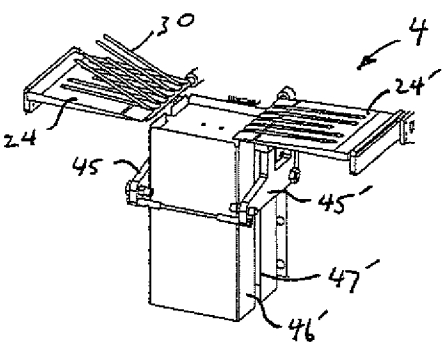
FIGS. 5A and 5B are perspective views of the apparatus of FIG. 4A, showing how the first flap fingers are pivoted through and upwardly away from the first supporting platform.
Figure 6B:
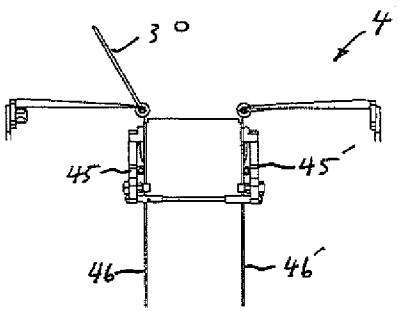
Figure 5B:
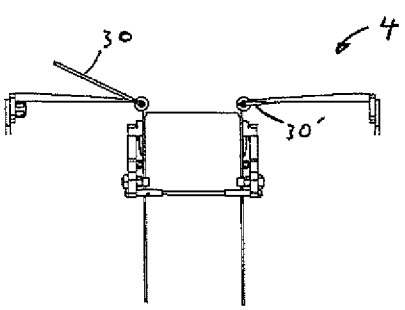
Figure 6C:
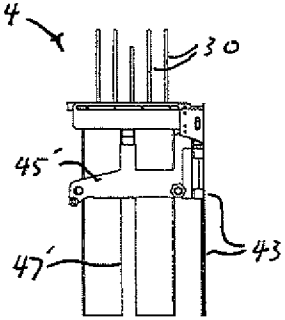

Initially, as shown in FIGS. 4C and 4D, first and second gloves 10A and 10B, are deposited at the glove stacking station. Then, as shown in FIGS. 5A and 5B, the first flap fingers 30 are pivoted through and upwardly away from the first supporting platform 24. The fingers pivot upwards towards vertical, as shown in FIGS. 6A, 6B and 6C, and back down towards the glove stacking area 20, as shown in FIGS. 7A and 7B.

Figure 7C:
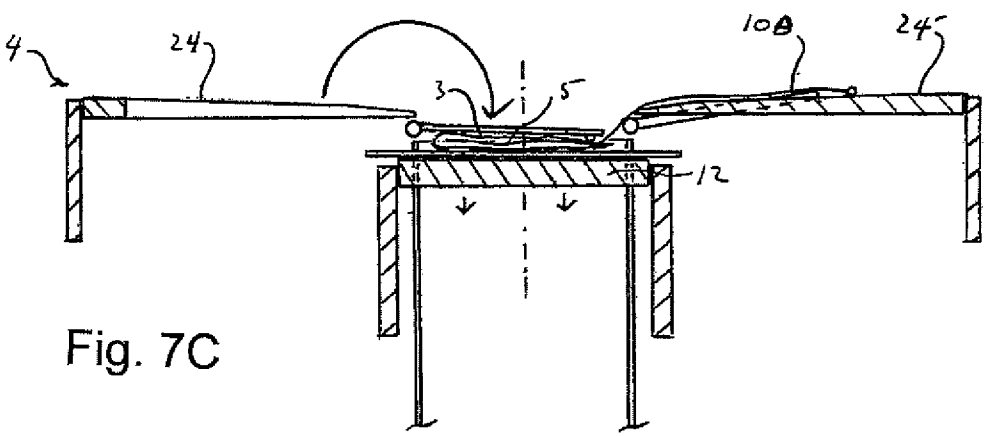
FIG. 7C is a schematic cross-section view of the apparatus of FIG. 7A, showing how the folding action of the first flap folds a first portion of the first deposited glove overlapping the first supporting platform over a second portion of the second deposited glove overlying the glove stacking area.

This folding action on the first deposited glove 10A is illustrated in FIG. 7C, from which it can be seen that the first flap 18 folds the cuff portion 3 of the first deposited glove over the second portion 5 of the second deposited glove 10B overlying the glove stacking area.

Figure 7D:
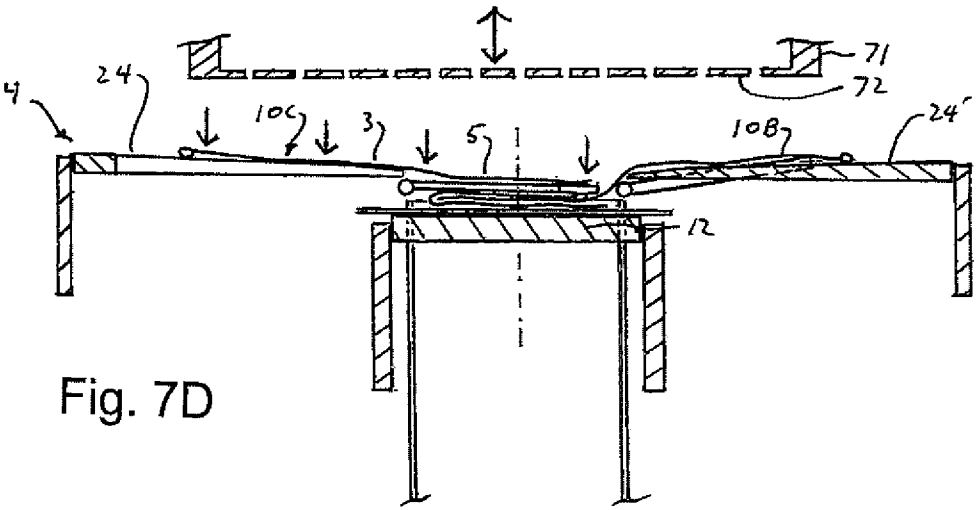
FIG. 7D is a schematic cross-section view following from FIG. 7C, showing how a third glove is deposited with a first portion of this glove overlapping the first supporting platform and a second portion of this glove lying above the first flap and over the first folded glove at the glove stacking area.
Figure 7A:
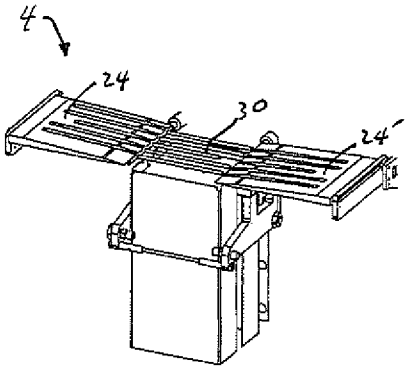
FIGS. 7A and 7B are perspective and front side views, following from FIGS. 6A and 6B, showing further pivoting of the flap fingers towards substantially horizontal over the glove stacking area, thereby completing a folding action of the first flap.
Figure 7B:
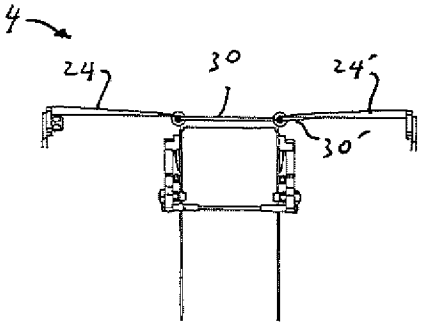

Then, as shown in FIG. 7D, a third glove 10C is deposited with the cuff portion 3 of this glove overlapping the first supporting platform 24 and the finger portion 5 of this glove lying above the first flap fingers 30 and over the first folded glove 10A at the glove stacking area.

From this it can be seen that the apparatus is configured to deposit gloves with the finger portion of each deposited glove being disposed over the fingers of the same flap that will fold the cuff portion of the same glove in the subsequent folding action.

It should be noted that the pressure on the fingers of the flap about to be withdrawn, applied by the fingers of the other flap, is not such as to inhibit withdrawal of the flap, or cause the flap to pull folded or unfolded glove portions in contact with the fingers out of or away from the glove stacking area.

Figure 8A:
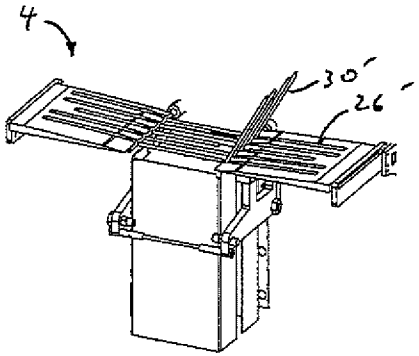
FIGS. 8A and 8B are perspective and front side views, following from FIGS. 7A and 7B, showing how the second flap is then pivoted upwards through the second platform slots and towards the glove stacking area.
Figure 8B:
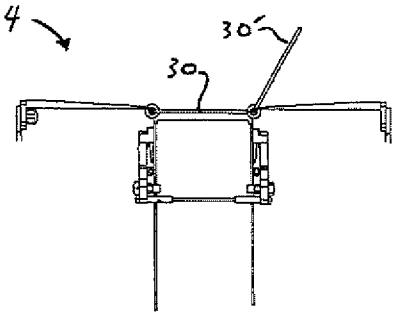

FIGS. 8A and 8B show how the second flap fingers 30' are then pivoted upwards through the second platform slots 26' and towards the glove stacking area 20, until the fingers of the second flap are substantially horizontal at the glove stacking area, thereby completing a folding action of the second flap.

Figure 9A:
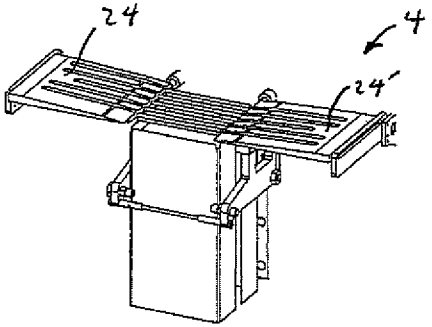
FIG. 9A is a perspective view following from FIG. 8A, showing how the fingers of the second flap are then pivoted to be substantially horizontal at the glove stacking area, thereby completing a folding action of the second flap.
Figure 9B:
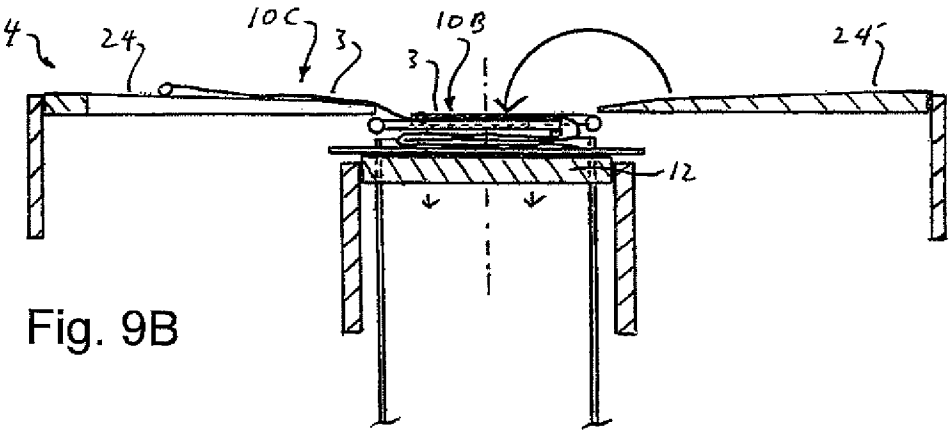
FIG. 9B is a schematic cross-section view following from FIG. 7D, showing how the second flap folds the first portion of the second deposited glove on top of the second portion of the third deposited glove, following which the fingers of both flaps press downwardly at the same time on the forming folded stack of gloves.

FIG. 9B shows the effect of this on the second deposited glove 10A. The second flap fingers fold the cuff portion 3 of the second deposited glove on top of the finger portion 5 of the third deposited glove 10C, following which the fingers of both flaps press downwardly at the same time on the forming folded stack of gloves 2.

This downward pressure from the fingers 30, 30' is a reaction force against an upwardly applied force from the recess floor 12. The rotation motors 32, 32' do not actively control this force, but do include torque sensors 48, 48' connected to the control system 40. The control system uses the vertical linear drive actuator 38 to adjust the elevation of the floor 12 up and down in order to maintain the pressure applied between the flap fingers and floor to within set limits. This also automatically results in the floor being lowered as gloves are added to the stack. The desired pressure will be different according to glove type, but is typically set to be between 1 and 5 Newtons, when the lateral folded dimensions of the stack of gloves is 118 mm by 125 mm.

Figure 11A:
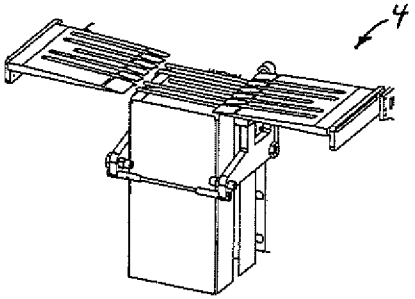
FIGS. 11A and 11B are perspective and front side views, following from FIGS. 10A and 10B, showing how the first flap continues to be laterally moved until the flap fingers are fully clear of the glove stack, thereby completing a withdrawing action of the first flap.
Figure 11B:
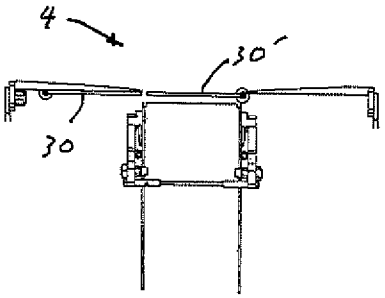
Figure 10A:
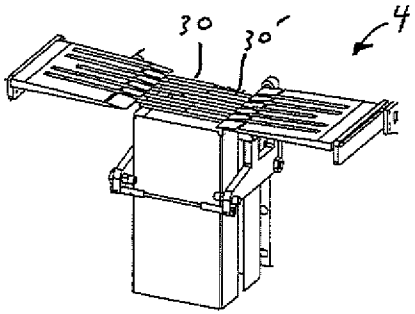
FIGS. 10A and 10B are perspective and front side views, following from FIG. 9A, showing how a pivot axis of the first flap is held in a fixed rotational orientation while the pivot shaft and flap fingers are moved laterally away from the stack of gloves so that the first flap fingers start to withdraw from between the adjacent folded glove portions.
Figure 10B:
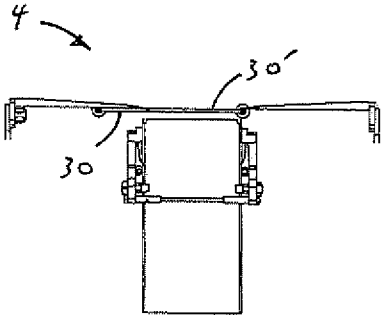

After the folding of the second glove, FIGS. 10A and 10B show how the pivot axis of the first flap is held in a fixed rotational orientation while being automatically moved laterally away from the recess in which the growing stack of gloves is held and supported so that the first flap fingers 30 start to withdraw from between the adjacent folded glove portions. FIGS. 11A and 11B show how the first flap continues to be laterally moved until the flap fingers 30 are fully clear of the recess and glove stack, thereby completing a withdrawing action of the first flap. During this process, the continuing pressure from the second flap maintains the lateral position of the glove portions so that these are not laterally dragged by the withdrawing of the first fingers.

Figure 12A:
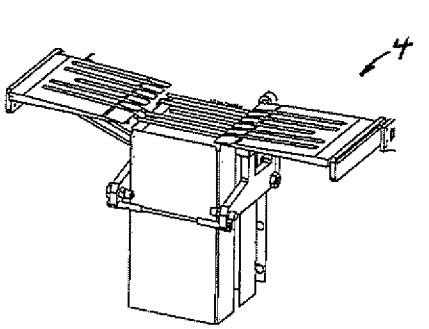
FIGS. 12A and 12B are perspective and front side views, following from FIGS. 11A and 11B, showing how the fingers of the first flap are then pivoted downwardly about the pivot axis.
Figure 12B:
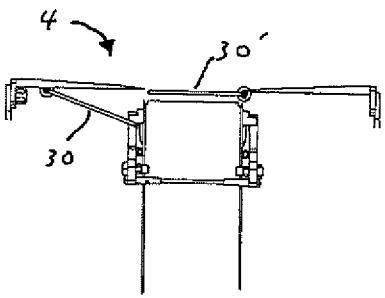
Figure 13C:
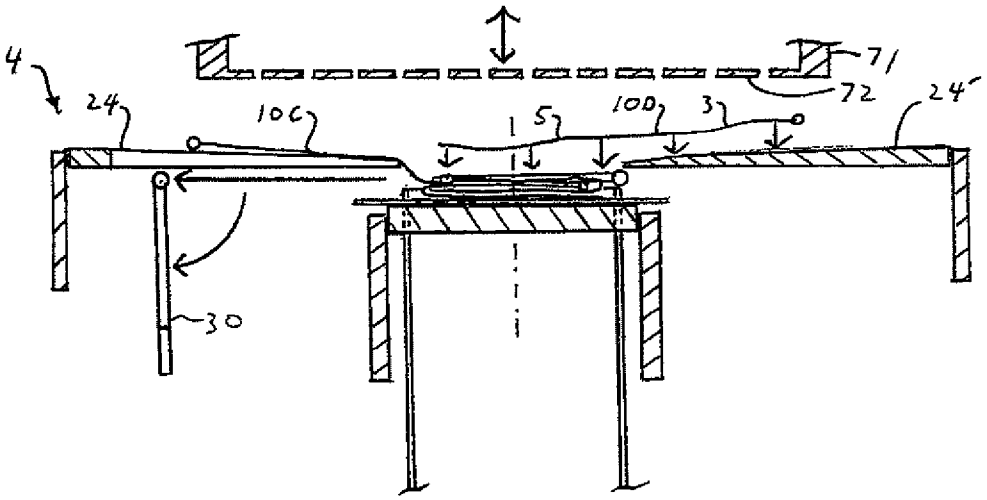
FIG. 13C is a is a schematic cross-section view following from FIG. 9B, showing how, after the withdrawing action of the first flap, a fourth glove is deposited with a first portion of this glove overlapping the second supporting platform and a second portion of this glove lying above the second flap and over the second folded glove at the glove stacking area.
Figure 13A:
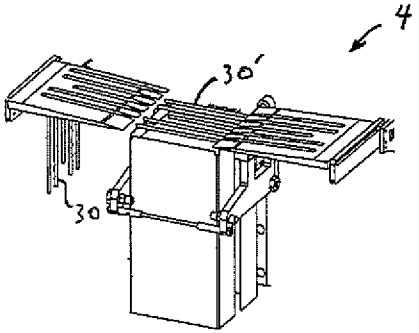
FIGS. 13A and 13B are perspective and front side views, following from FIGS. 12A and 12B, showing how the fingers of the first flap continue to pivot until the fingers extend vertically downwards.
Figure 13B:
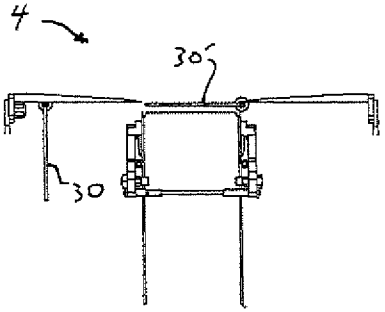

Once fully withdrawn, FIGS. 12A and 12B, show how the fingers 30 of the first flap are then pivoted downwardly about the pivot axis, until vertical, as shown in FIGS. 13A and 13B.

As can be seen from FIG. 12B, the middle-most finger of each flap is relatively shorter than the rest to enable this finger to clear components that extend through the recess side slots 47, 47' when the floor is 12 relatively near the level of the flap pivot axes 19, 19'. These components include a portion of the brackets 45, 45' connected to the floor, as well as a pair of magnetic material tabs 13, 13' that extend laterally outwards from the packing plate 14 through the recess side slots 47, 47'. In use, during final packing of gloves into a dispenser, these tabs engage with magnets on the outside of a rigid material packing box and facilitate removal of the compressed stack from the packing recess, as described in the prior art mentioned above. It will therefore be appreciated that the exact lengths of the fingers are not important as long as the fingers are long enough to impart sufficient angular momentum to the glove portion being folded that the cuff portion falls substantially flat and stretched away from the glove fold.

FIG. 13C is a is a schematic cross-section view following from FIG. 9B, showing how, after the withdrawing action of the first flap, a fourth glove 10D is deposited with the cuff portion 3 of this glove overlapping the second supporting platform 24' and the finger portion 5 of this glove lying above the second flap fingers 30' and over the second folded glove 10B at the glove stacking area 20.

Figure 15:
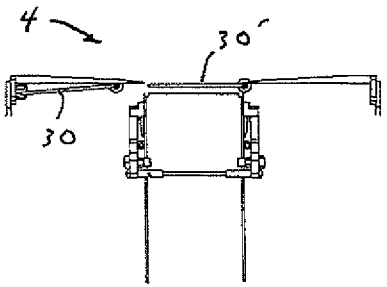
FIGS. 14 and 15 are front side views, following from FIG. 10B, showing how the first flap continues to pivot about the first pivot axis while the same time the first pivot axis is moved laterally back towards the glove stack.
Figure 14:
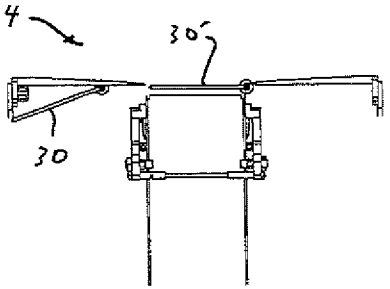
Figure 16C:
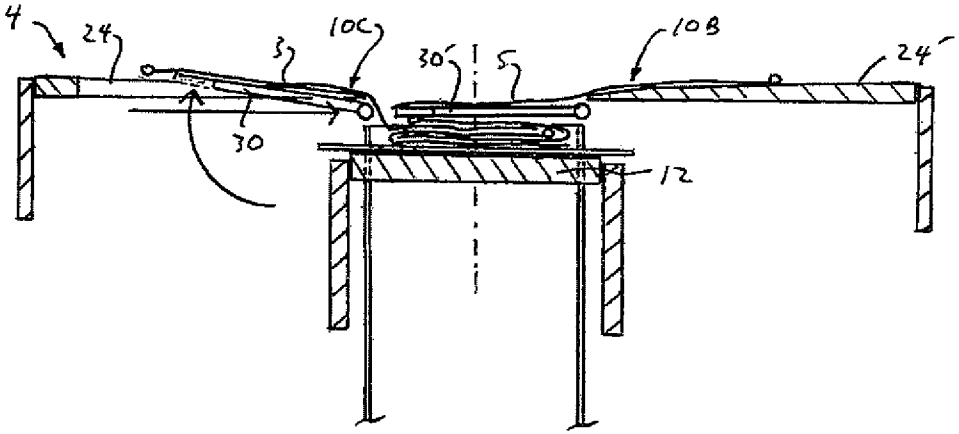
FIG. 16C is a is a schematic cross-section view following from FIG. 13C, showing how the first flap, having completed the first full cycle, is oriented to fold the first portion of the third deposited glove in the next folding action.
Figure 16A:
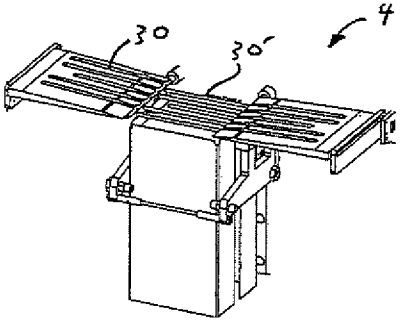
FIGS. 16A and 16B are perspective and front side views, following from FIG. 15, showing how the first flap continues to pivot and move laterally until the first flap is positioned in the same initial position of FIG. 4A, thereby completing a returning action of the first flap and a first full cycle of movement for the first flap.
Figure 16B:
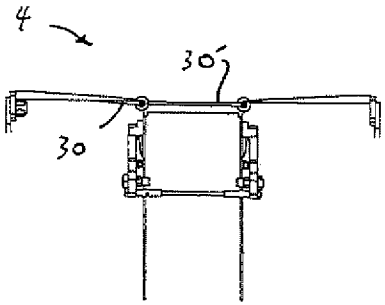

Meanwhile, as this is happening, FIGS. 14 and 15 show how the first flap 18 continues to pivot about the first pivot axis while the same time the first pivot axis is moved laterally back towards the packing recess and the glove stack until, as shown in FIGS. 16A and 16B the first flap is positioned in the same initial orientation or position of FIG. 4A, thereby completing a returning action of the first flap and a first full cycle of movement for the first flap.

Figure 17:
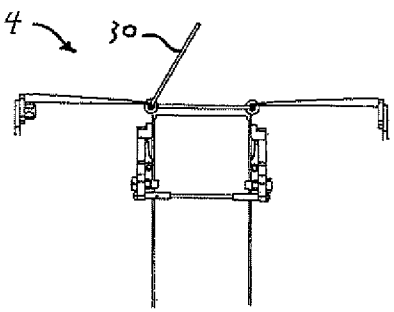
FIG. 17 is a front side view, following from FIG. 16B, showing how the first flap fingers then pass through the slots in the first supporting platform and pivot towards the glove stacking area, while the second flap fingers remain in a substantially horizontal orientation.
Figure 18C:
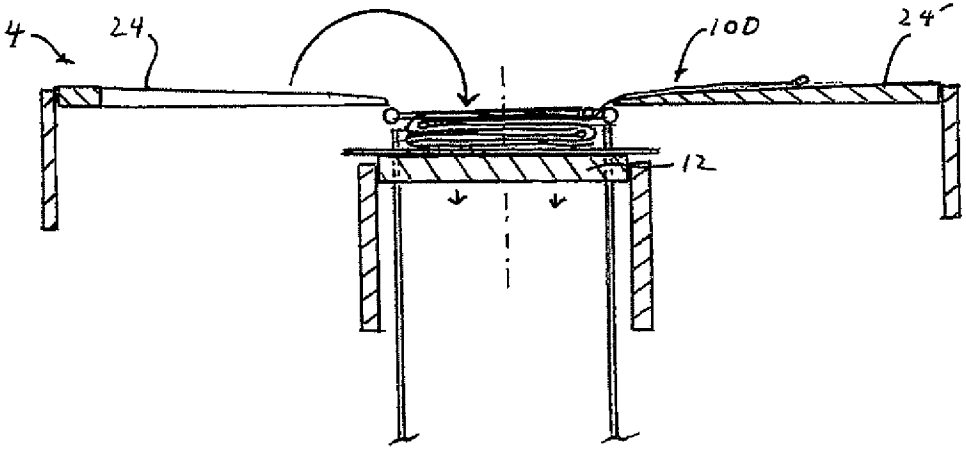
FIG. 18C is a is a schematic cross-section view following from FIG. 16C, showing how the first flap folds the first portion of the third deposited glove on top of the second portion of the fourth deposited glove, following which the fingers of both flaps press downwardly at the same time on the forming folded stack of gloves.
Figure 18A:
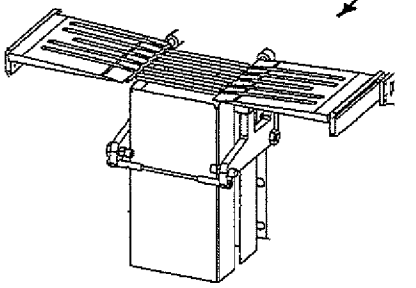
FIGS. 18A and 18B are perspective and front side views, following from FIG. 17, showing further pivoting of the flap fingers towards substantially horizontal over the glove stacking area, thereby completing another folding action of the first flap.
Figure 18B:
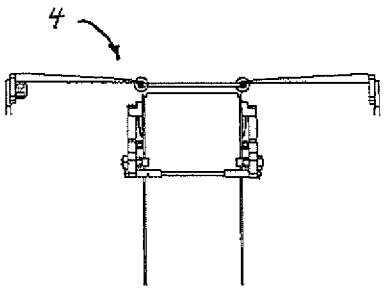

Then as shown in FIG. 16C, the first flap, having completed the first full cycle, is oriented to fold the cuff portion 3 of the third deposited glove 10C, in the next folding action. During this process, as shown in FIGS. 17, 18A and 18B the first flap fingers 30 pass through the slots in the first supporting platform 24 and pivot towards the glove stacking area 20, while the second flap fingers 30' remain in a substantially horizontal orientation. The effect of this is shown in FIG. 18C, in which it can be seen that the cuff portion 3 of the third deposited glove 10C is folded over on top of the finger portion 5 of the second deposited glove 10B, thereby completing another folding action of the first flap.

Following this, pressure continues to be exerted on the stack between the fingers 30, 30' of both flaps and the recess base surface 6.

Figure 19:
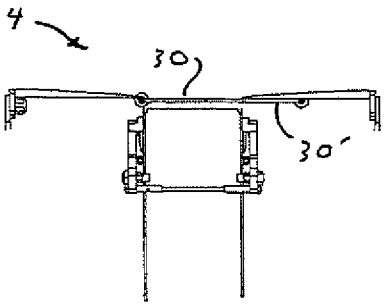
FIG. 19 is a front side view, following from FIG. 18B, showing how a pivot axis of the second flap is then held in a fixed rotational orientation while being moved laterally away from the stack of gloves so that the second flap fingers start to withdraw from between the adjacent folded glove portions.

FIG. 19 shows how the pivot axis of the second flap is then held in a fixed rotational orientation while being moved laterally away from the recess and the stack of gloves so that the second flap fingers 30' start to withdraw from between the adjacent folded glove portions. Once the fingers 30' are fully clear of the recess, as shown in FIGS. 20A and 20B, a withdrawing action of the second flap is completed.

Figure 20C:
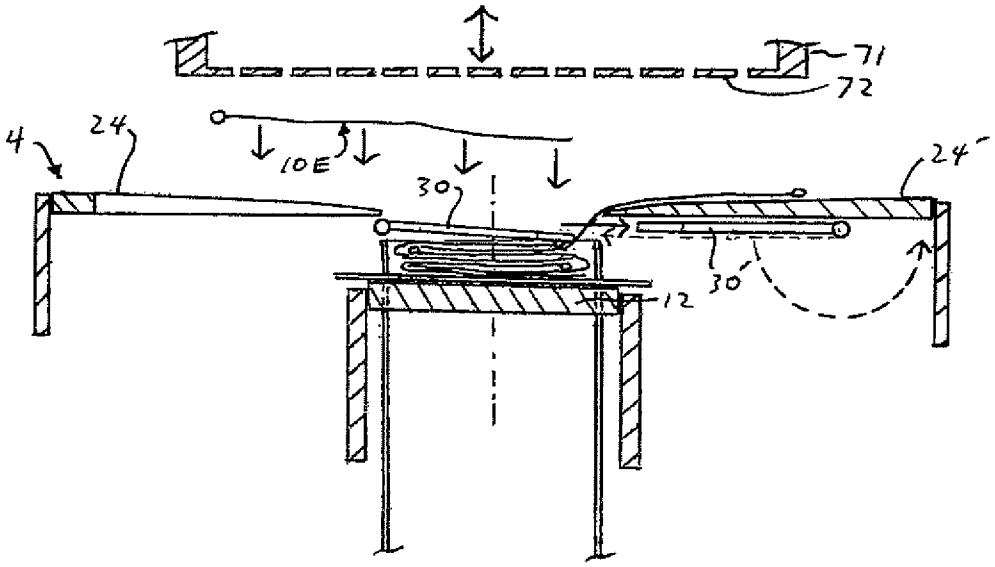
FIG. 20C is a is a schematic cross-section view following from FIG. 18C showing how, after the withdrawing action of the second flap, a fifth glove is deposited with a first portion of this glove overlapping the first supporting platform and a second portion of this glove lying above the first flap and over the third folded glove at the glove stacking area, during which time the second flap pivots and laterally moves in a subsequent returning action.
Figure 20A:
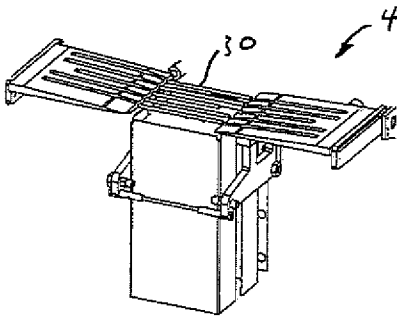
FIGS. 20A and 20B are perspective and front side views, following from FIG. 19, showing how the second flap continues to be laterally moved until the flap fingers are fully clear of the glove stack, thereby completing a withdrawing action of the second flap.
Figure 20B:
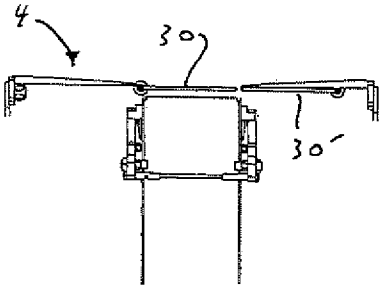

At about the same time as this, FIG. 20C shows how a fifth glove 10E is deposited with the cuff portion 3 of this glove overlapping the first supporting platform 24 and the finger portion 5 of this glove lying above the first flap and over the third folded glove 10C at the glove stacking area 20. During this glove deposition, the second flap 18' pivots and laterally moves in a subsequent returning action.

Figure 22:
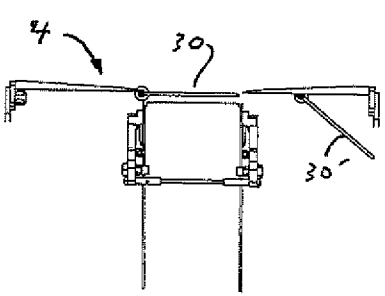
FIGS. 21 to 23 are front side views, following from FIG. 20B, showing how the fingers of the second flap are then pivoted downwardly about the pivot axis until past vertical when the pivot axis starts to move laterally back towards the stack until the pivot axis has returned to its initial position with the flap fingers substantially horizontal, thereby completing the returning action of the second flap and a first full cycle of movement for the second flap.
Figure 21:
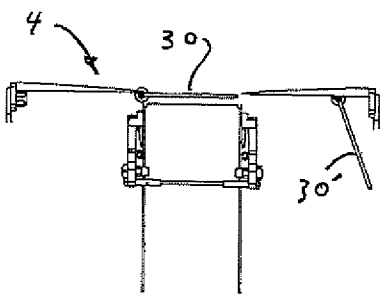
Figure 23:
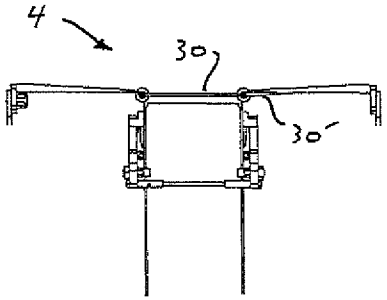
Figure 28:
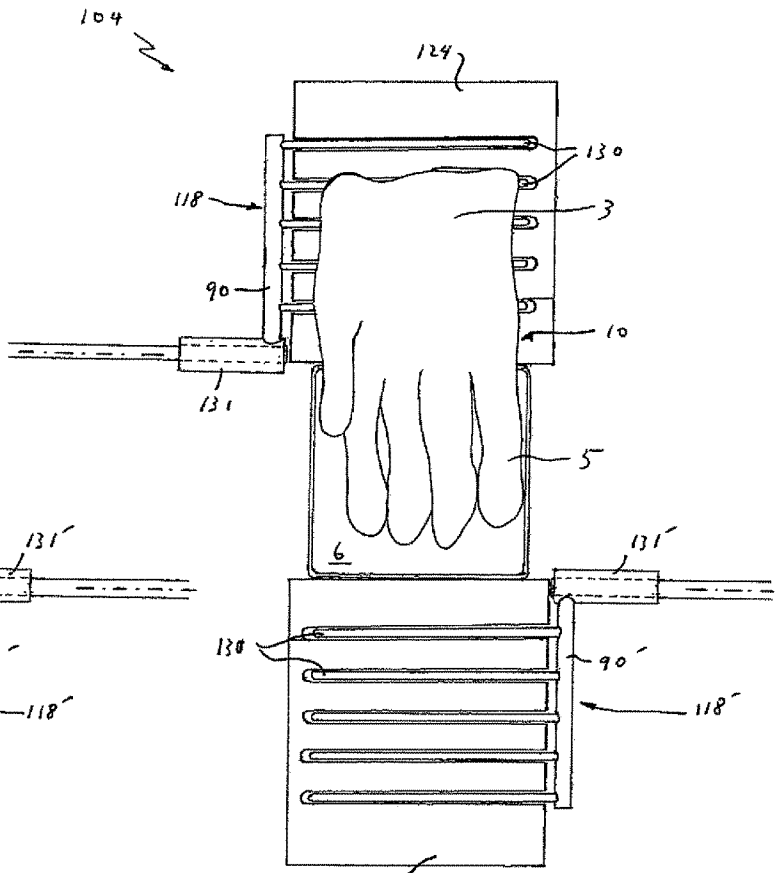
FIGS. 28 and 29 show how, in the second embodiment, a first glove is deposited partially over the first flap and the associated supporting platform and partially over the glove stacking area, followed by deposition of a second glove over the second flap and the associated supporting platform and partially over the first glove at the glove stacking area, the fingers of each flap being directed away from the glove stacking area.
Figure 27:
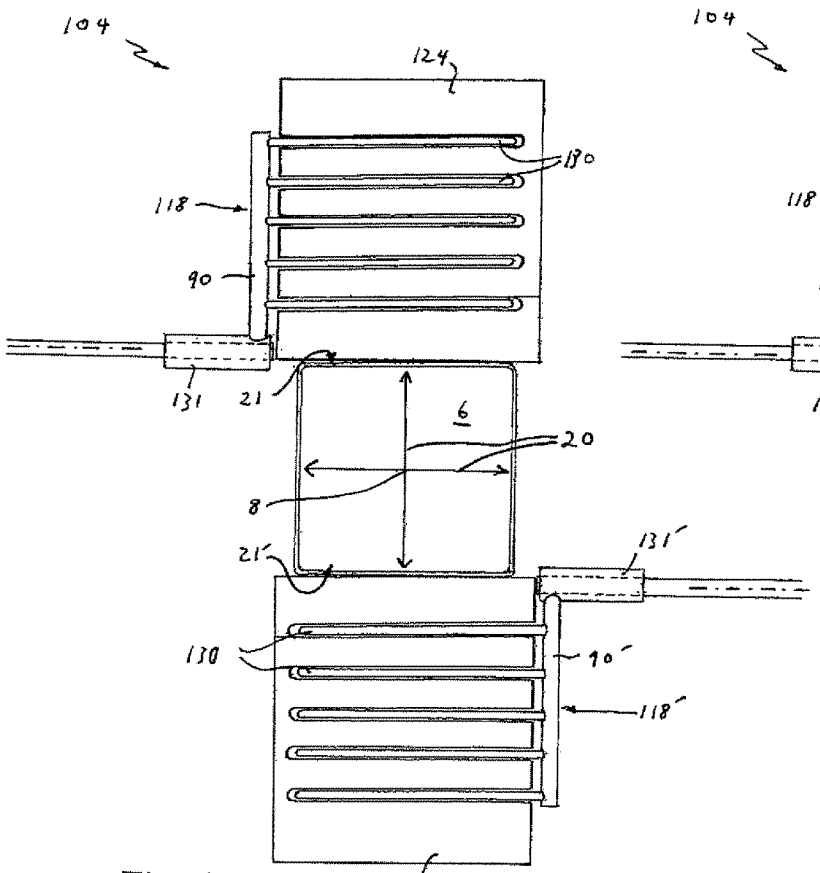
FIG. 27 shows in plan view a glove stacking apparatus for forming a stack of folded gloves in a second preferred embodiment of the invention, comprising a glove stacking station having a pair of flaps on opposite sides of the opening to the glove packing recess for containing alternately folded gloves, the flaps having fingers that extend substantially parallel rather than perpendicular to the pivot axis.
Figure 30:
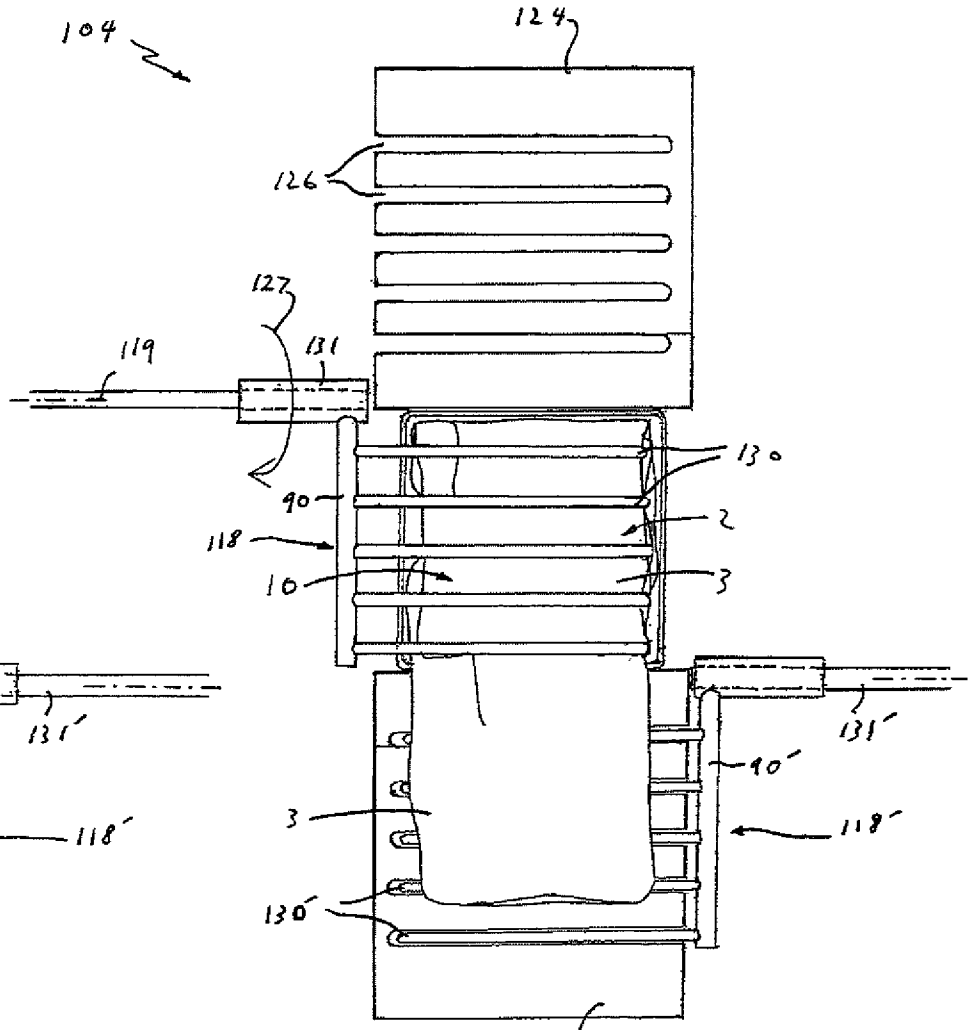
FIG. 30 shows how the first flap fingers are pivoted through and upwardly away from the first supporting platform to fold a second, cuff portion of the first glove over a first, finger portion of the second glove.
Figure 29:
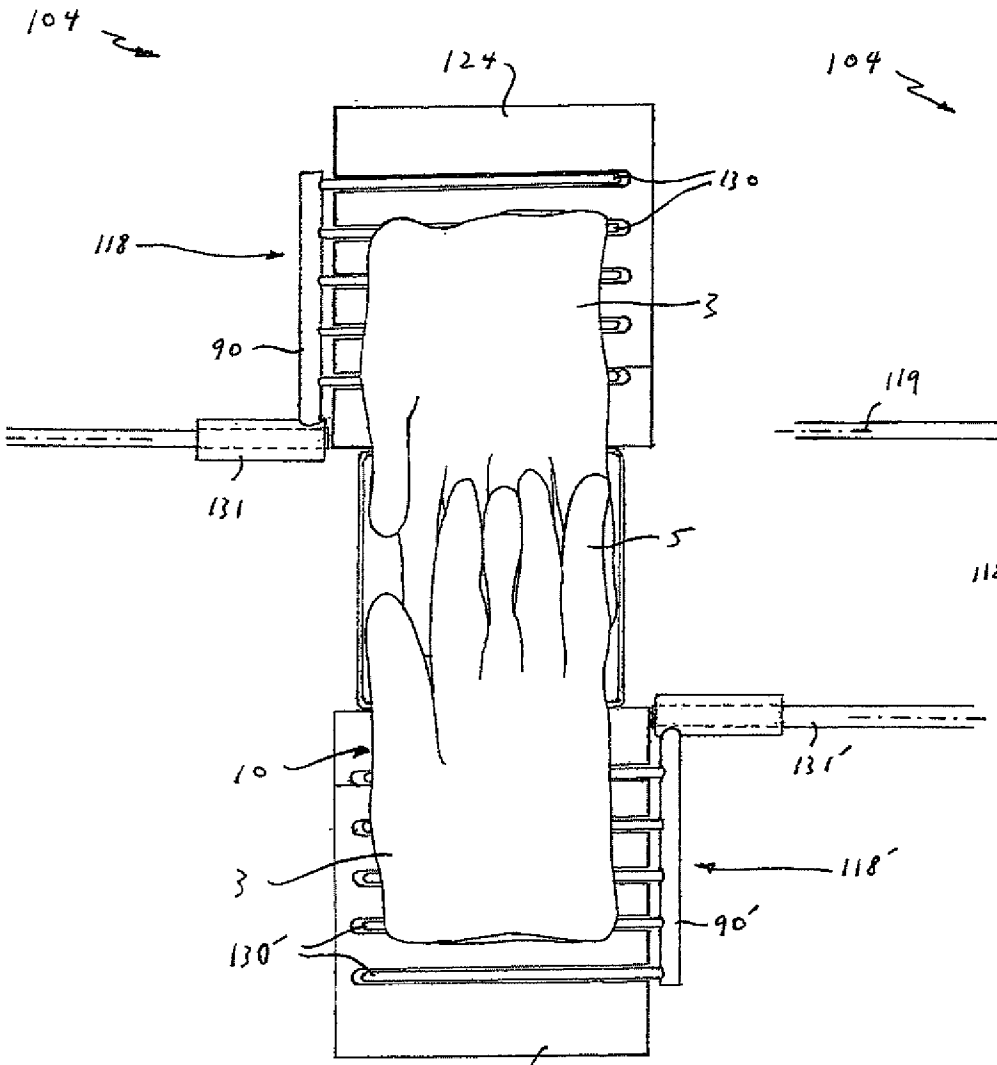
Figure 32:
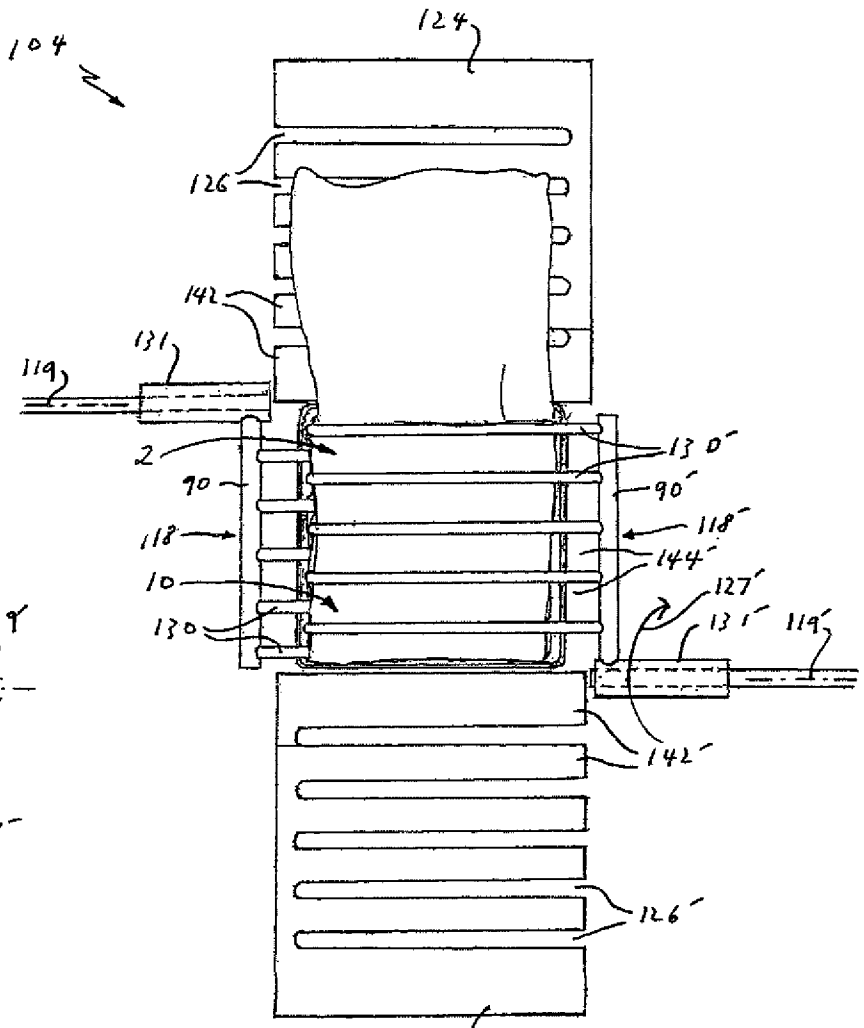
FIG. 32 shows how the second flap is then pivoted to fold the first, cuff portion of the second deposited glove over the second, finger portion of the third deposited glove.
Figure 31:
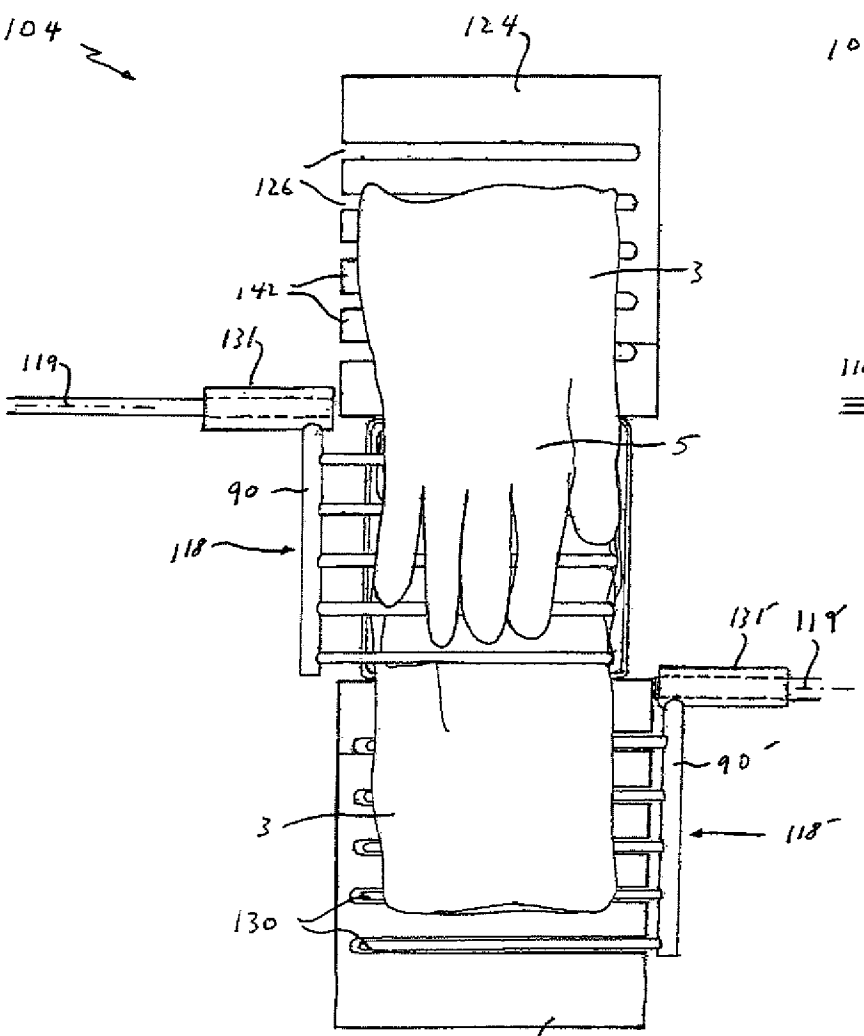
FIG. 31 shows how a third glove is deposited with a first, cuff portion of this glove overlapping the first supporting platform and a second, finger portion of this glove lying above the first flap and over the first folded glove at the glove stacking area.

FIGS. 21, 22 and 23 show how the fingers 30' of the second flap are then pivoted downwardly about the pivot axis until past vertical when the pivot axis starts to move laterally back towards the recess and the stack until the pivot axis has returned to its initial position with the flap fingers being substantially horizontal, thereby completing the returning action of the second flap and a first full cycle of movement for the second flap.

Figure 25:
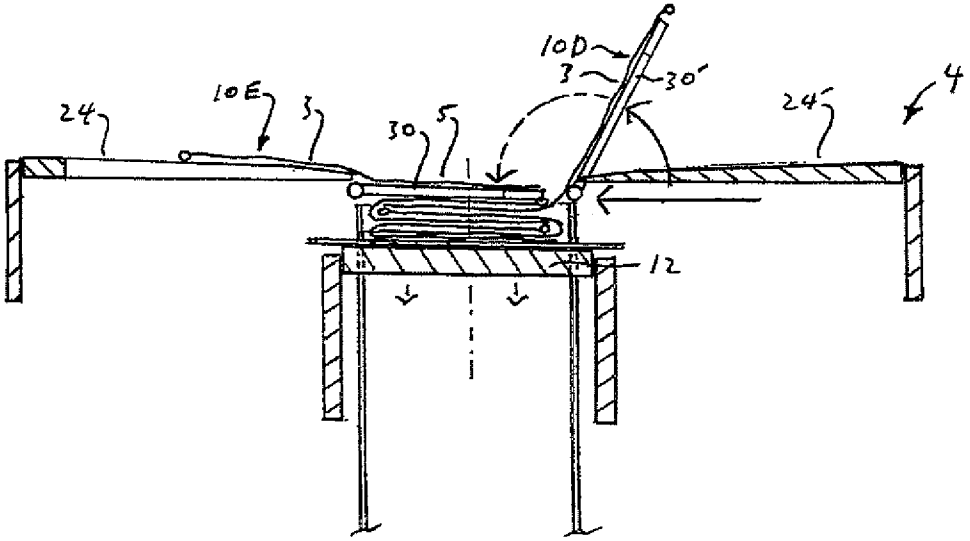
Figure 24:
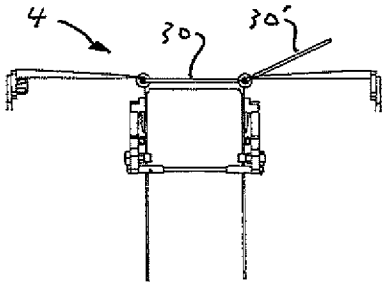
FIG. 24 is a front side view and 25 is a is a schematic cross-section view following from FIG. 23 showing how, after the returning action of the second flap, the fingers of the second flap start to fold the fourth glove in the next folding action.

FIGS. 24 and 25 show how, after the returning action of the second flap, the fingers 30' of the second flap start to fold the cuff portion 3 of the fourth glove 10D in the next folding action until this lies on top of the finger portion 5 of the fifth glove 10E.

Figure 26A:
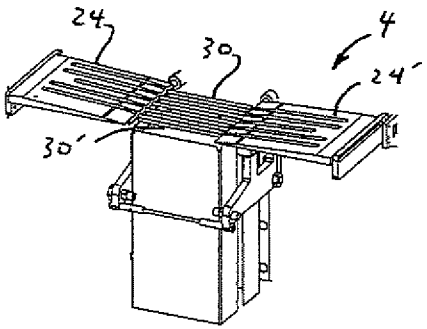
FIGS. 26A and 26B are perspective and front side views, following from FIG. 24, showing how the second flap pivots fully until the flap fingers are substantially horizontal over the glove stacking area, thereby completing another folding action of the second flap.
Figure 26B:
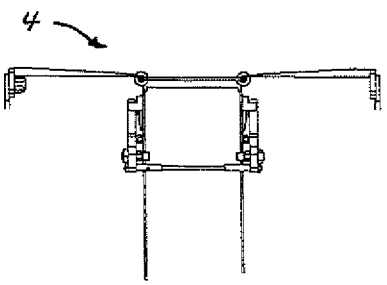

FIGS. 26A and 26B show the final orientation of the second flap after this has fully pivoted in the folding action, thereby completing a cycle of operation of the glove folding system.

FIGS. 27 to 34 show in plan view a second embodiment of a glove stacking and folding station 104 which may be used in place of the glove stacking and folding station 4 described above. Features which correspond with those in the feature embodiment are references using numerals incremented by 100. The principles of for folding operation and stacking of gloves are the same as that described above, except in this instance, the first and second flaps 118, 118' are oriented substantially parallel with the first and second pivot axes 119, 119', instead of being substantially perpendicular. To achieve this, the flap fingers 130, 130' are connected to the pivot axes by via an intermediate member 90, 90', that extends perpendicularly away from an end portion of the pivot shaft 131, 131'. The finger may, however, be joined to the pivot shaft in any other way.

This embodiment also has first and second supporting platforms 124, 124' that are disposed, respectively, on the opposite first and second sides 21, 21' of the glove stacking area 20. These platforms may have the same thickness in the vertical direction of the platforms 24, 24' These platforms provide support to the cuff portion 3 of a deposited glove 10 prior to folding of the cuff portion 3 towards and onto the growing stack 2 at the stacking area by the fingers 130, 130' of the corresponding flap 118, 118'. Each supporting platform 124, 124' has a plurality of slots 126, 126' that are aligned with the fingers 130, 130' of the corresponding flap when the flap is in the first orientation.

Between the slots 126, 126' each platform has slats or projections 142, 142'. The flap fingers 130, 130' are separated by gaps 144, 144'. The platform slats are aligned with corresponding finger gaps. As in the first embodiment, sufficient clearance, in practice about 1 mm on each side, is provided so that the slots in each platform allow passage of the fingers through the corresponding platform as the flap cyclically automatically moves through a repeating series of actions under the overall control of the control system 40.

As in the first embodiment the first flap 118 is pivotable 127 about the first pivot axis 119 and the second flap 118' is pivotable 127' about a second pivot axis 119', these axes being parallel with each other and perpendicular with and laterally offset from the stacking axis 8. The first and second axes 119, 119' are disposed on corresponding opposite first and second sides 21, 21' of the glove stacking area 20 within which gloves 10 folded by the flaps are, in use, added to the stack 2.

Figure 34:
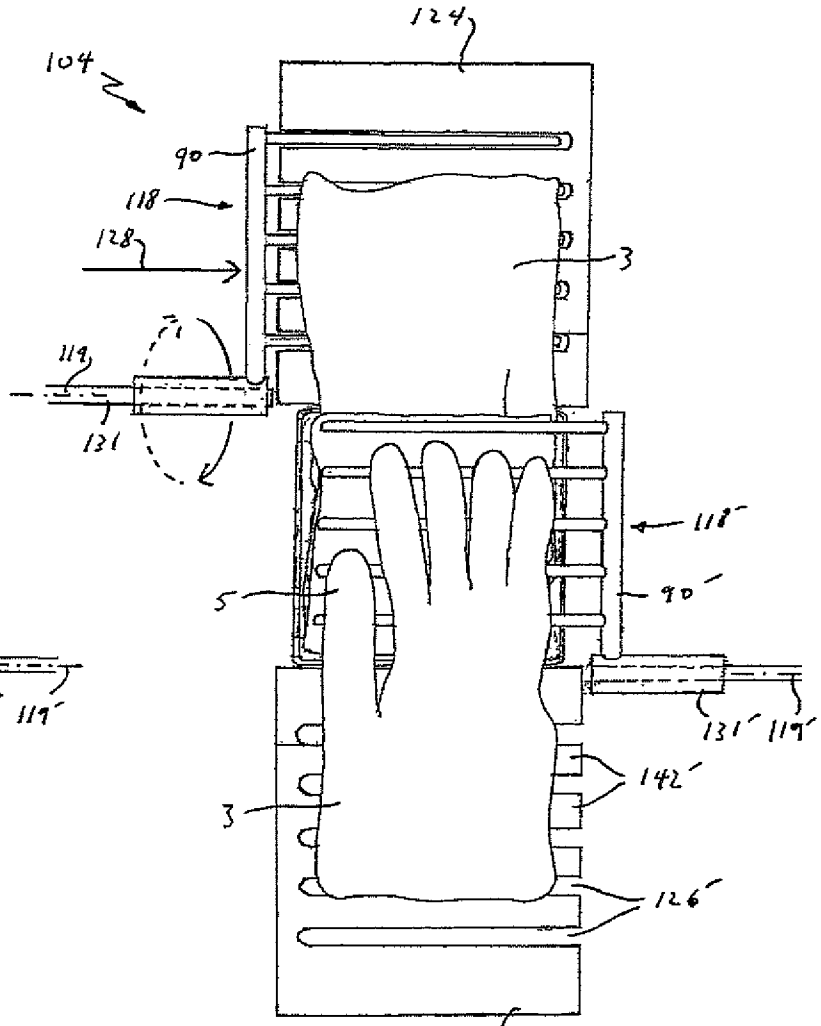
FIG. 34 shows how the first flap is returned to the initial position, by first rotating and then by moving laterally back towards the initial orientation ready for the next folding action, during which action a fourth glove is deposited over the second flap and the associated supporting platform and partially over the cuff portion of second deposited glove at the glove stacking area.
Figure 33:
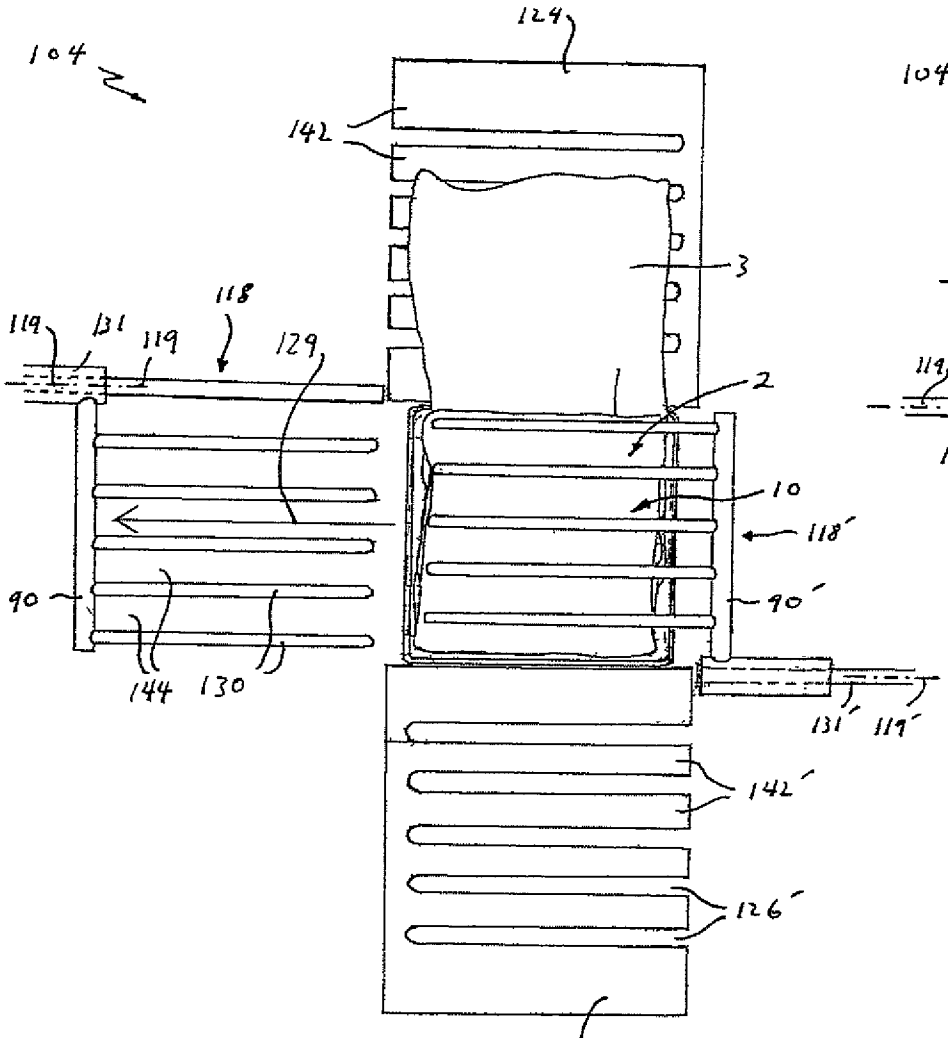
FIG. 33 shows how a pivot axis of the first flap is held in a fixed rotational orientation while the pivot shaft and flap fingers are moved laterally away froth the stack of gloves so that the first flap fingers start to withdraw from between the adjacent folded glove portions.

In this embodiment, the pivot shafts 131, 131' when retracted in the withdrawing action laterally move axially, along the pivot axes in a direction away 129 from the glove stacking area 20. As shown in FIG. 34, the retracted fingers may then, in the subsequent returning action, be rotated by 180° and moved laterally back towards 128 the corresponding side of the glove stacking area, ready in the first orientation for the next folding action.

As in the first embodiment, each slot 126, 126' extends through the corresponding platform 124, 124', which optionally may have the same thickness in the vertical direction as in the first embodiment. The advantage of this is that during the returning action, the fingers may enter the slots, or be moved into position just below the level of the slots, and the glove supported on the platform, in different ways. For example, following completion of the rotation, by movement in the axial, horizontal direction; or, as in the first embodiment, by rotating into the slots from below. As shown schematically in. FIG. 34, the rotation may therefore be either above (dotted curved arrow) or below (solid curved arrow) the plane of the glove stacking area.

Alternatively, the slots may be grooves in the top surface of the platform, which may therefore be thicker than that illustrated, the grooves being open at one end to receive the fingers in the axial, horizontal direction. The grooves would, however, have to be deep enough so that the fingers did not brush against or disturb the underside of the previously deposited glove. In this case, the slats or projections 142, 142' would be lands between the grooves.

Whether the slots are apertures or grooves, the slots of each platform are aligned with the fingers of the corresponding flap when the flap is in the first orientation to accommodate movement of the fingers during the cycle of the flap actuation system.

Not shown in FIGS. 27 to 34, for the sake of conciseness, are modifications needed to the mechanical actuators and sensors. Suitable modifications will be apparent to the person skilled in the art.

FIGS. 27 to 34 show process steps that are analogous to those shown and described above in relation to FIGS. 1 to 16C. Not shown, again for the sake of conciseness, are the process steps following from FIG. 34, analogous to those shown and described above in relation to FIGS. 17 to 26B in which:

the first portion of the third glove resting on the first platform is folded over the second portion of the fourth glove;

the fingers of the second flap are laterally withdrawn, and then rotated and moved back into alignment with the slots of the second supporting platform, thus completing full cycles of both flaps.

It will be appreciated that in the method described above, the control system 40 synchronises the deposition of gloves by the rest of the glove depositing apparatus and the folding of gloves by the flap actuation system, in such a way as to minimise the cycle time.

The recess 17 is about 600 mm deep when the floor is fully lowered. When stacking and folding nitrile medical inspection gloves of 3 g weight using prior art folding machinery as disclosed in WO 2010/020782 A2, WO 2011/048414 A1 and WO 2014/037701 A1 it has been possible to stack and fold about 180 gloves in this depth. Using the apparatus and method according to the invention described above, the number is increased to about 250 gloves. Because the glove layers are continuously compressed, it is easier and quicker to compress air out the completed stack when the floor is used to ram the stack up against the inside of a rigid packing box positioned above the top of the recess. The result is that 250 gloves can readily be packed in a standard size glove dispensing box, as opposed to between 125 and 180, as has possible in the prior art. As glove weight is expected to be reduced towards 2.5 g, it is expected that up to 500 gloves can be packed in a recess 600 mm long.

The increased packing density is achieved not just by helping to keep air from being drawn into the stack owing to the elastic rebound of the material in the folded gloves, but also by better control of the location of the fold line. Apart from the fold imparted to the first glove 10A, it can be seen from the above description that in each subsequent fold, the glove about to be folded is held down proximate the forthcoming fold line by at least some of the fingers of the other flap not doing the folding. The fold lines are therefore reliably and repeatedly positioned near the two opposite sides of the stack adjacent the first and second sides 21, 21' of the glove stacking area 20. This helps to minimise wasted space within the glove stack as well as helping to keep the glove layers relatively flat between these sides.

It will also be appreciated that the invention completely avoids any pneumatic effects that could cause a lifting Or a shifting of the top folded layer, which can happen in the prior art when a glove folding flap simply retraces its path after the folding of a glove.

The production line will normally have two stacking stations 4 per robot 70, one recess being filled with folded gloves while the other is emptied of a completed stack. One control system 40 can also be used to control two stacking stations. When one recess is full, a worker will activate the control system 40 to compress the glove stack upwards out of the recess into a packing rigid packing box, as known in the prior art. While this is taking place, the robot starts to fill a previously emptied packing recess at the other stacking station. Gloves are placed and folded at a rate of about one per second and so it will take about 250 seconds to fill up the packing recess. Prior art glove folding apparatus would take about 180 seconds to place and fold 180 gloves in the same size packing recess. The increased time is an advantage on the production line because this gives enough time, nearly 4 minutes, for one worker to remove and pack the gloves before the packing station has to be ready to start receiving gloves. It is harder to achieve this within 3 minutes without using two workers or without periodically shutting down the belt conveyor.

The invention therefore affords greater convenience to the end user, and greater economy on the production line. The end user can store more gloves or store the same number of gloves in less space, and a glove dispenser will need refilling less often. In production, the labour requirement is reduced owing to the cycle time between changing over completed packing recesses being increased. During transportation, more gloves can be packed inside a standard 40 foot shipping container.

The invention therefore provides a convenient apparatus and method for stacking gloves prior to packing in a dispensing box.

It is to be recognized that various alterations, modifications, and/or additions may be introduced into the constructions and arrangements of parts described above without departing from the spirit or scope of the present invention, as defined by the appended claims.

What is claimed is:

1. A glove stacking apparatus for forming a stack of folded gloves, comprising:

a supporting surface for supporting said stack as folded gloves are added to the stack along a stacking axis;

a first flap pivotable about a first pivot axis and a second flap pivotable about a second pivot axis, said first and second flaps pivotable about first and second pivot axes being disposed on corresponding opposite first and second sides of a glove stacking area within which gloves folded by said flaps are, in use, added to the stack, the supporting surface being relatively movable with respect to said glove stacking area along said stacking axis away from said glove stacking area as said folded gloves are added to the stack and wherein each flap, in addition to being pivotable about the corresponding axis, is also laterally movable both towards and away from the glove stacking area and comprises a plurality of fingers for folding a first portion of a deposited glove overlapping said flap, said fingers extending in a lengthwise direction and being separated by gaps;

a cyclic flap actuator, configured for driving each flap through a plurality of cycles of movement of the flap comprising a folding cycle, a withdrawing cycle and a returning cycle, wherein during said folding cycle, said cyclic flap actuator is configured to drive a folding action of each flap in which said flaps alternately pivot about the corresponding pivot axis from a first orientation in which said flap is positioned on its corresponding side of the glove stacking area to a second orientation in which said flap extends over the glove stacking area, whereby each flap when in the first orientation is configured to fold said first portion of said deposited glove overlapping said flap towards a second portion of said glove deposited at the glove stacking area as said flap pivots to the second orientation, the folding action of said flaps alternating as gloves are added to the stack;

wherein said cyclic flap actuator is configured for subsequent to driving said folding cycle of each flap, and during said withdrawing cycle, to drive a withdrawing action of each flap in which said flaps are alternately withdrawn from the glove stacking area, said flap to be withdrawn being maintained in the second orientation while being laterally moved away from the glove stacking area along said lengthwise direction until said fingers are withdrawn from the glove stacking area;

and wherein said cyclic flap actuator is configured for subsequent to driving said withdrawing cycle of each flap, and during said returning cycle, to drive a returning action of each flap in which said previously withdrawn flap is pivoted about the pivot axis and laterally returned to the first orientation ready for the next folding action, whereby the flap actuator completes a cycle; and wherein said glove stacking apparatus further comprises a first supporting platform and a second supporting platform, said first and second supporting platforms being disposed, respectively on said opposite first and second sides of the glove stacking area for supporting said first portion of a deposited glove prior to folding of said first portion by the fingers of the corresponding flap, each supporting platform having a plurality of slots therein, the slots of each platform being aligned with the fingers of the corresponding flap to accommodate movement of said fingers during said cycle of the flap actuator.

2. The glove stacking apparatus as claimed in claim 1, in which the fingers of said flap, when in its first orientation, extend away from the corresponding side of the glove stacking area.

3. The glove stacking apparatus as claimed in claim 1, in which the fingers of said flap extend substantially perpendicular to the corresponding pivot axis.

4. The glove stacking apparatus as claimed claim 1, in which said fingers extend substantially perpendicularly away from a pivot shaft on which said fingers are mounted, said pivot shaft being rotatable about said pivot axis, and the flap in said returning action is laterally returned to the first orientation by moving the pivot shaft towards the corresponding side of the glove stacking area.

5. The glove stacking apparatus as claimed in claim 4, in which each pivot shaft moves laterally beneath the corresponding supporting platform as the flap actuator drives each flap throughout said cycle of movement of each flap.

6. The glove stacking apparatus as claimed in claim 1, in which each platform has an upper surface and a lower surface, the upper surface being configured to provide said support to said first portion of a deposited glove, said withdrawing cycle of each flap taking place beneath the lower surface.

7. The glove stacking apparatus as claimed in claim 1, in which each flap, during the returning cycle simultaneously pivots about the corresponding pivot axis and moves laterally such that the pivot axis moves towards the glove stacking area.

8. The glove stacking apparatus as claimed in claim 1, in which the fingers of said flap, when in its first orientation, extend substantially parallel with the corresponding side of the glove stacking area.

9. The glove stacking apparatus as claimed in claim 1, in which the fingers of said flap extend substantially parallel to the corresponding pivot axis.

10. The glove stacking apparatus as claimed in claim 1, in which said fingers extend in a substantially parallel orientation with respect to a pivot shaft on which said fingers are mounted, said pivot shaft being rotatable about said pivot axis, and the flap in said returning action is laterally returned to the first orientation by moving the pivot shaft towards the corresponding side of glove stacking area.

11. The glove stacking apparatus as claimed in claim 1, in which said flap in said first orientation extends from the corresponding pivot axis in a direction away from the glove stacking axis to a second orientation in which said flap extends from the corresponding pivot axis in a direction towards the glove stacking area.

12. The glove stacking apparatus as claimed in claim 1, in which said fingers of each flap pass through the slots of the corresponding platform during the folding action of said flap.

13. The glove stacking apparatus as claimed in claim 1, in which the withdrawing cycle of each flap does not occur until after the folding cycle of the other flap, whereby the fingers of both flaps are in contact with the stack until said withdrawing cycle has occurred.

14. The glove stacking apparatus as claimed in claim 13, in which at least one finger of each flap is aligned with a corresponding gap of the other flap when both flaps are in contact with the stack.

15. The glove stacking apparatus as claimed in claim 14, in which the width of each one of said gaps in each flap is greater than the width of the finger in the other flap with which said gap is aligned.

16. The glove stacking apparatus as claimed in claim 1, in which the flap actuator is configured to maintain each flap in the second orientation after each folding cycle to apply a downward pressure to said stack until after the other flap has completed a subsequent folding cycle.

17. The glove stacking apparatus as claimed in claim 1, in which at least one flap applies a compressive force to said stack at all times during the alternate folding of gloves as gloves are added to the stack.

18. The glove stacking apparatus as claimed in claim 1, in which each flap comprises a base portion, the fingers extending away from the base portion of said flap.

19. A method of forming a stack of folded gloves using a glove stacking apparatus for forming a stack of folded gloves, the glove stacking apparatus including a supporting surface for supporting said stack as folded gloves are added to the stack along a stacking axis; a first flap pivotable about a first pivot axis and a second flap pivotable about a second pivot axis, said axes also being laterally movable with respect to a glove stacking area within which gloves folded by said flaps are, in use, added to said stack, said first and second axes being disposed on corresponding opposite first and second sides of a glove stacking area and the flap comprising a plurality of fingers; a cyclic flap actuator, configured for driving each flap through a plurality of cycles of movement comprising a folding cycle, a withdrawing cycle and a returning cycle, wherein during said folding cycle, said cyclic flap actuator is configured to drive a folding action of each flap in which said flaps alternately pivot about the corresponding pivot axis; and a first supporting platform and a second supporting platform, said first and second platforms being disposed, respectively on said opposite first and second sides of the glove stacking area, the first supporting platform being configured to be used in conjunction with the first flap and the second supporting platform being configured to be used in conjunction with the second flap, each supporting platform having a plurality of slots therein, wherein the method comprises the acts of:

depositing a sequence of gloves to be folded into a stack by said apparatus, each glove having a first portion and a second portion, one of said portions being a finger portion and the other of said portions being a cuff portion, the first portion of each glove being deposited, alternately, at one or the other of said platforms and the second portion of each glove being deposited at the glove stacking area;

when a glove is deposited with the first portion at the first platform, using the first platform to support said glove and using the flap actuator to pivot the fingers of the first flap about the first pivot axis in said folding cycle of said flap to lift said first portion off the first platform and to fold said first portion towards the glove stacking area until the fingers of the first flap extend over the glove stacking area, said folded glove thereby being added at the top of the stack of folded gloves;

when a glove is deposited with the first portion at the second platform, using the second platform to support said glove and using the flap actuator to pivot the fingers of the second flap about the second pivot axis in a folding action of said flap to lift said first portion off the second platform and fold said first portion towards the glove stacking area until the fingers of the second flap extend over the glove stacking area, said folded glove thereby being added at the top of the stack of folded gloves;

as said alternately folded gloves are added to the stack of folded gloves, using the supporting surface to support said stack while relatively moving the supporting surface away from the glove stacking area so that the top of said stack remains substantially level with said pivot axes so that said flaps may continue to alternately fold and add to said stack subsequently deposited gloves;

after each folding cycle, using the flap actuator to drive said withdrawing cycle of the corresponding flap in which said fingers are laterally withdrawn towards a side of the glove stacking area, said fingers thereby being withdrawn from said stack;

after each withdrawing cycle, using said flap actuator to pivot and laterally move said flap in said returning cycle of the corresponding flap to return said flap to a position ready for a subsequent folding action; and either during the folding cycle or during the returning cycle of each flap, passing the fingers of said flap through the slots in the corresponding supporting platform.

20. The method as claimed in claim 19, in which the method comprises, for each one of said flaps, after the folding cycle of said flap and prior to the subsequent to said withdrawing cycle of said flap, the step of depositing the subsequent glove with the second portion of said subsequently deposited glove overlying the fingers of said flap atop a previously folded glove at the glove stacking area and the first portion of said subsequently deposited glove being supported on the supporting platform used in conjunction with said flap until following said subsequent withdrawing cycle of said flap the first portion of said subsequently deposited glove is lifted from said platform in the subsequent folding cycle of said flap.

21. The method as claimed in claim 19, in which the method comprises, for each one of said flaps, after said step of depositing said subsequent glove and prior to said subsequent withdrawing action and subsequent folding action of said flap, the step of using the flap actuator to pivot the fingers of the other one of said flaps in an interleaving folding action to fold the first portion of the previously deposited glove over the second portion of said subsequently deposited glove, whereby the first portion of each glove within the stack is sandwiched between adjacent second portions and the second portion of each glove within the stack is sandwiched between adjacent first portions of glove.

22. The method as claimed in claim 19, in which each pivot axis rotates and moves laterally beneath the level of the corresponding supporting platform.

23. The method as claimed in claim 22, in which the fingers of each flap are initially pivoted upwardly through said slots during the folding action of each flap and then pivoted downwardly towards the glove stacking area.

24. The method as claimed in claim 19, in which following each folding cycle, each flap applies a downwards pressure to said stack through the fingers of said flap until said fingers are withdrawn from the stack during the withdrawing cycle.

25. The method as claimed in claim 19, in which following each folding cycle, the fingers of each one of said flaps are maintained in contact with said first portion folded by said flap until after the subsequent folding cycle of the other one of said flaps, whereby the fingers of both flaps are at times during the cycle of the flap actuator simultaneously in contact with the corresponding folded gloves of said stack.

26. The method as claimed in claim 25, in which the fingers of each one of said flaps are interlaced with the fingers of the other one of said flaps, whereby the fingers of each of said flaps do not bear directly on the fingers of the other one of said flaps when both are in contact with the corresponding folded gloves of said stack.

* * * * *